US006530322B1

(12) United States Patent
Ono et al.

(10) Patent No.: US 6,530,322 B1
(45) Date of Patent: Mar. 11, 2003

(54) SUCTION TRANSPORT DEVICE OF A PRINTING PLATE

(75) Inventors: Tsukasa Ono, Kanagawa (JP); Takashi Koizumi, Kanagawa (JP); Yoshinori Kawamura, Kanagawa (JP); Kazuhisa Tazaki, Saitama (JP)

(73) Assignees: Fuji Photo Film Co., Ltd., Kanagawa (JP); Fuji Photo Optical Co., Ltd., Saitama (JP)

( * ) Notice: Subject to any disclaimer, the term of this patent is extended or adjusted under 35 U.S.C. 154(b) by 0 days.

(21) Appl. No.: 09/663,365

(22) Filed: Sep. 15, 2000

(30) Foreign Application Priority Data

Sep. 17, 1999 (JP) ..... 11-264086

(51) Int. Cl.[7] ..... B44B 5/00; B41F 27/00; B41L 47/14

(52) U.S. Cl. ..... 101/389.1; 101/477; 101/420; 101/23

(58) Field of Search ..... 101/477, 420, 101/23, 389.1; 396/517

(56) References Cited

U.S. PATENT DOCUMENTS 5,537,926 A * 7/1996 Beisel et al. ..... 101/477
5,611,272 A * 3/1997 Steuer ..... 101/23
5,809,360 A * 9/1998 Blake et al. ..... 396/517
5,992,324 A * 11/1999 Rombult et al. ..... 101/477
6,000,337 A * 12/1999 Blake et al. ..... 101/477
6,269,743 B1 * 8/2001 DeMoore et al. ..... 101/420

* cited by examiner

*Primary Examiner*—Andrew H. Hirshfeld
*Assistant Examiner*—Marvin P. Crenshaw
(74) *Attorney, Agent, or Firm*—Sughrue Mion, PLLC

(57) ABSTRACT

A suction transport device capable of reducing manufacturing cost due to reduction of the number of suction mechanisms by which one of photopolymer plates accommodated in a magazine is taken out is attained. Also separability when the printing plate is taken out is improved, thus improving reliability of the suction transport device. Since, among suckers and suction fans, those located at positions corresponding to the widthwise direction ends of the printing plates are movable in the widthwise direction, and separating plates are movable in the same direction. When one of the printing plates of a different size is to be taken out, the leading end corner portions of the printing plate can always be curved at a fixed curvature, and separability is improved. Further, there is no need to increase the number of suckers thus decreasing cost.

24 Claims, 20 Drawing Sheets

SUCTION TRANSPORT DEVICE OF A PRINTING PLATE

BACKGROUND OF THE INVENTION

1. Field of the Invention

The present invention relates to a suction transport device of a printing plate in which one of printing plates which are accommodated in a magazine is sucked by a suction mechanism, and in this state, the printing plate is taken out from the magazine and transported to a predetermined position.

2. Description of the Related Art

Technology (in the form of printing plate automatic exposure devices and the like) has been developed whereby an image is recorded onto a printing plate (referred to hereinafter as a photopolymer plate). The photopolymer plate is provided with a photosensitive layer (e.g. a photopolymerization layer) on top of a base layer. The image is recorded at the photopolymer plate's photopolymerization layer with a direct laser beam or the like.

With this sort of technology, images can be recorded onto photopolymer plates quickly. Therefore, sequential feeding of the photopolymer plates is required. For this reason, a plurality of the photopolymer plates, and interleaf sheets for protecting surfaces of the photopolymer plates are alternately accommodated in advance in a magazine in a stacked state. The photopolymer plates and interleaf sheets held in a standby state in predetermined positions are then automatically taken one at a time, by being sucked by a suction mechanism of suckers and fans, and fed into an exposure section.

The magazine accommodating the photopolymer plates therein is also provided with separating plates that correspond to both tip end corner portions of the photopolymer plates accommodated therein. When one of the photopolymer plates is taken out from the magazine by the suction mechanism which includes suckers and fans, these separating plates engage with the photopolymer plate so as to curve the leading end corner portions of this photopolymer plate. Thus, the suctioned photopolymer plate is speedily peeled off from the photopolymer plate that is therebeneath, and taken out.

In a conventional device, because the suction mechanism having suckers and suction fans is disposed fixedly, in a case in which photopolymer plates of a different size are suctioned and taken out, there has been a need to adjust the suckers and the suction fans according to the size of the photopolymer plates.

Also in this case, when the suckers located at the widthwise direction both end portions of the photopolymer plates suck the end portions of the photopolymer plates closer to the end portions of the photopolymer plates (closer to the separating plates), the curvature of the corner portion of the photopolymer plates becomes smaller when the photopolymer plate is curved. Thus, the suckers will have an excellent so-called separability. Therefore, the suckers are preferably provided so as to be positioned at the widthwise direction both end portions of the photopolymer plates. However, if the suckers are disposed fixedly as described above, when an attempt is made to suck, as far as possible, the end portions of the photopolymer plate, it becomes necessary to increase the number of suckers (decreasing the pitch with which the suckers are disposed).

On the other hand, when a photopolymer plate is taken out by the suction mechanism from the magazine, the separating plate which engages with the photopolymer plate and curves the leading end corner portions of the photopolymer plate must curve the tip end corner portions of the photopolymer plate at a fixed curvature. Thus, even with a photopolymer plate of different size, it is desirable that the relative positions of the separating plates and the photopolymer plates correspond at a fixed position.

It is a known fact that when a photopolymer plate is taken out by the suction force of the suckers, the closer to the end portions of the photopolymer plate the suckers are located, the smaller the curvature radius when the photopolymer plate is curved so that separability can improve. However, the optimum dimension (for example, a dimension of the distance between the leading portions of the photopolymer plates and the suckers or a dimension of the distance between the side edges of the photopolymer plate and the suckers) has not yet been established.

SUMMARY OF THE INVENTION

In view of the aforementioned facts, an object of the present invention is to provide a suction transport device of a printing plate in which manufacturing cost can be reduced by decreasing the number of suction mechanisms which are needed to take out one of the printing plates which are accommodated in a magazine and in which separability of the printing plates, when the printing plate is taken out, improves, thus improving reliability of the device.

Another object of the present invention is to provide a suction transport device of a printing plate in which a position for sucking the printing plates at which separability is maximized can be clearly established.

In accordance with a first aspect of the present invention, there is provided a suction transport device for use with printing plates, the device comprising: a container in which printing plates are accommodated when the device is used, with the printing plates stacked on top of one another; and a plurality of suction mechanisms disposed at positions opposing the printing plates, along a width direction of the printing plates, at least one of the suction mechanisms being movable in the width direction, wherein the suction mechanisms are operable for removing each printing plate from the container, separately from the other printing plates.

In the suction transport device of the first aspect of the present invention, the printing plates which are accommodated in the container are sucked by the suction mechanisms, and in this state, are taken out from the container, and transported to a predetermined position.

A plurality of suction mechanisms are disposed at positions that oppose the printing plates in the widthwise direction thereof, and at least one of the suction mechanisms located at the widthwise direction of the printing plates can move in the widthwise direction of the printing plates. Accordingly, in a case in which the printing plates of a different size is sucked and taken out, if the movable suction mechanisms can move in accordance with the size of the printing plates, the suction mechanisms can be applied to printing plates of any size.

In this case, in particular, the number of the suction mechanisms is not increased (the pitch at which the suckers and the suction fans are disposed is not decreased). The suction mechanisms can be provided so as to suck portions of the printing plates closer to the widthwise direction end portion thereof by causing the suction mechanisms to move. Also, the curvature of the corner portions of the printing plates is decreased so that a so-called separability relative to the printing plates can improve.

In this way, in the suction transport device of the present invention, the number of the suction mechanisms needed to take the printing plate are reduced so that the reduction of a manufacturing cost can be attained. Separability relative to the printing plates when one of the printing plates is to be taken out improves, thus improving reliability.

In accordance with a second aspect of the present invention, there is provided A suction transport device for use with a plurality of printing plates and interleaf sheets, each printing plate having opposite ends and a leading end corner portion, with each printing plate separated from an adjacent printing plate by an interleaf sheet, the device comprising: a container in which the printing plates and interleaf sheets are placed when the device is used, the container including separation plates disposed movably in a width direction of the printing plates at positions corresponding to leading end corner portions of said printing plates, for aiding in separating an uppermost printing plate in the container from the remaining printing plates of said plurality; and a plurality of suction mechanisms disposed in the width direction of the printing plates at positions opposing the printing plates, with suction mechanisms located along the width direction at either end of the printing plates being disposed movably, and those located in a central vicinity of the width direction of the printing plates being disposed fixedly, the suction mechanisms being operable such that the printing plates and the interleaf sheets are sucked and removed from the container separately from one another.

In the suction transport device of the second aspect of the present invention, when a printing plate is taken out by the suction mechanisms from the container, a pair of plates engage with the printing plate, curve the leading end corner portion of the printing plate, and peel the same. Therefore, separability of the printing plates improves, thus improving reliability.

In this case, since the separating plates can move in the widthwise direction of the printing plates which are accommodated in the magazine, when a printing plate of a different size is to be sucked and taken out, if the separating plates which have been movable in accordance with the size of the printing plate, even with the printing plates of different size, the separating plates and the printing plates can be disposed so as to correspond at a fixed relative position. As a result, the leading end corner portions of the printing plates can always be curved at a fixed curvature so that separability of the printing plates improves more, thus improving reliability.

In the suction transport device of the first or second aspect of the present invention, the suction mechanisms are positioned on the basis of marks.

The positioning of the suction mechanisms after the suction mechanisms have been moved is carried out on the basis of marks. The marks are provided in advance in accordance with the size of the printing plates, thus facilitating the positioning of the suction mechanisms. Further, a corresponding plate size may be specified together with the marks, and the plate size (letters) per se may be used as marks.

Furthermore, the marks are points on the scale disposed along moving tracks of the suction mechanisms. The marks are points on the scale and the amount by which the suction mechanisms are moved can be visually recognized by a T system. That is, it is not necessary to set the marks in accordance with the size of the printing plate each time a moving operation of the suction mechanisms is performed. The suction mechanisms can be moved by an amount corresponding to a difference between a previous size (positions at which the suction mechanisms are now positioned) and a current size (positions at which the suction mechanisms are to be positioned) of the printing plates.

The scale can be always set, or can be set for the suction mechanisms in accordance with moving tracks of the suction mechanisms when needed.

BRIEF DESCRIPTION OF THE DRAWING

FIG. 12A illustrates a state in which a temporary support arm is at a horizontal position;

FIG. 12B illustrates a state in which the temporary support arm is in a withdrawn position; and FIG. 12C illustrates a state in which the temporary support arm is at a pushed-up position.

DESCRIPTION OF THE PREFERRED EMBODIMENTS

First Embodiment (Overall Structure)

Figure 1:
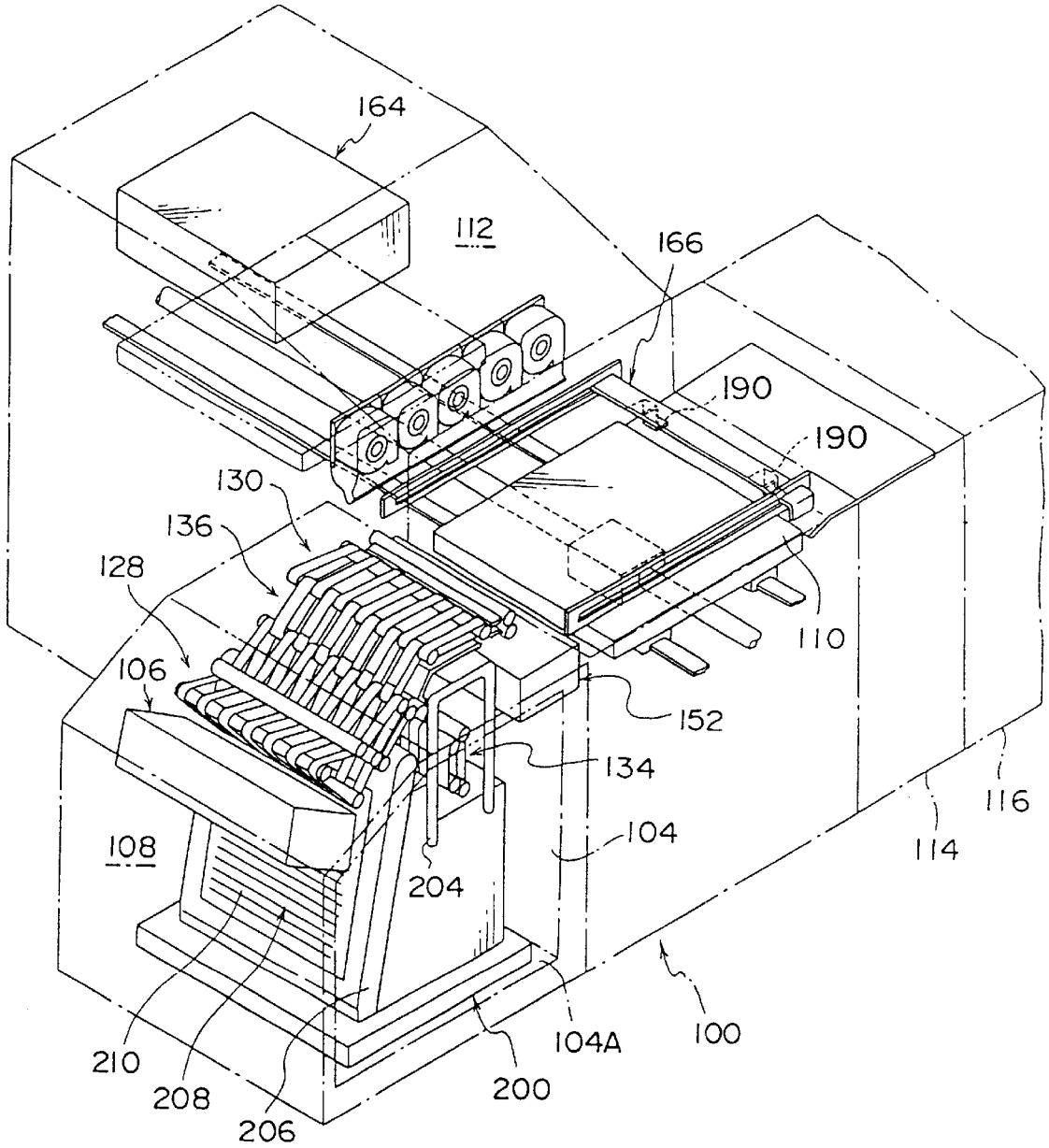
FIG. 1 is a perspective view illustrating an overall structure of an automatic exposure device according to a first embodiment of the present invention.

FIG. 1 shows a perspective view of an overall structure of an automatic exposure device 100 of a photopolymer plate as a printing plate, which is structured by using a suction transport device 109 according to a first embodiment of the present invention.

The automatic exposure device 100 is formed by a plate feed section 108, a surface plate 110 and an exposure section. The plate feed section 108 is provided with a plate accommodating section 104, which is mounted on a trolley 200 and which accommodates photopolymer plates 102 (see FIG. 2), and a sheet delivery section 106, which takes out the photopolymer plates 102 accommodated at the plate accommodating section 104. On the surface plate 110, one of the photopolymer plates 102 is held in position. The exposure section 112 records an image onto the photopolymer plate 102 which is held in position at the surface plate 110.

Further, an automatic developing device 116 can be provided at the downstream side of the automatic exposure device 100, via a buffer portion 114. Thus, plate feeding, exposure and developing can all be processed automatically.

Figure 2:
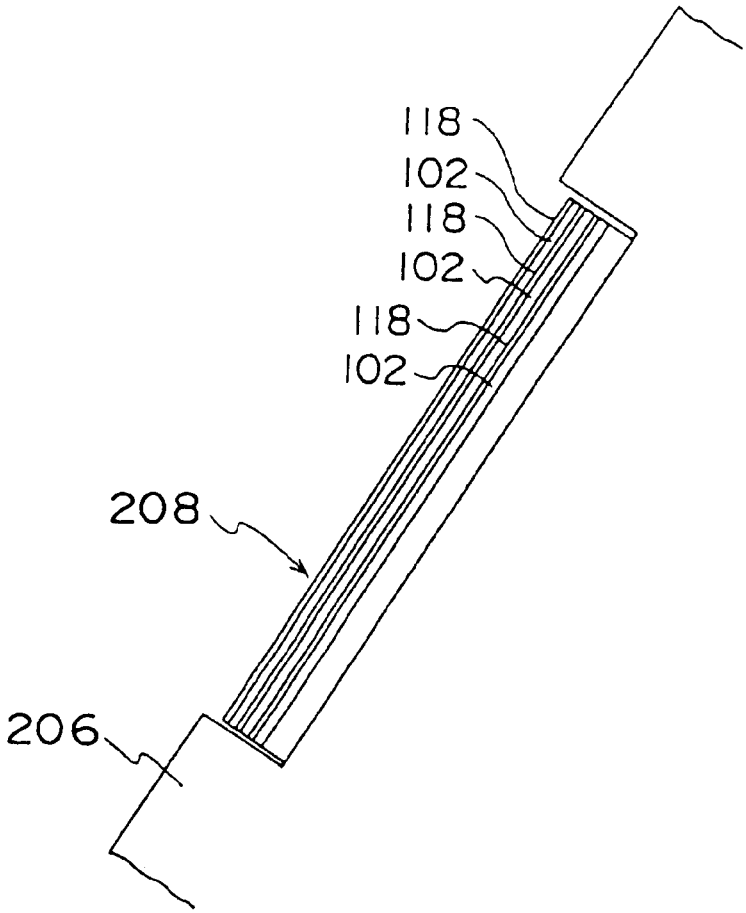
FIG. 2 is a side view illustrating a state of photopolymer plates and interleaf sheets which are stacked in a magazine according to the first embodiment of the present invention.
Figure 3:
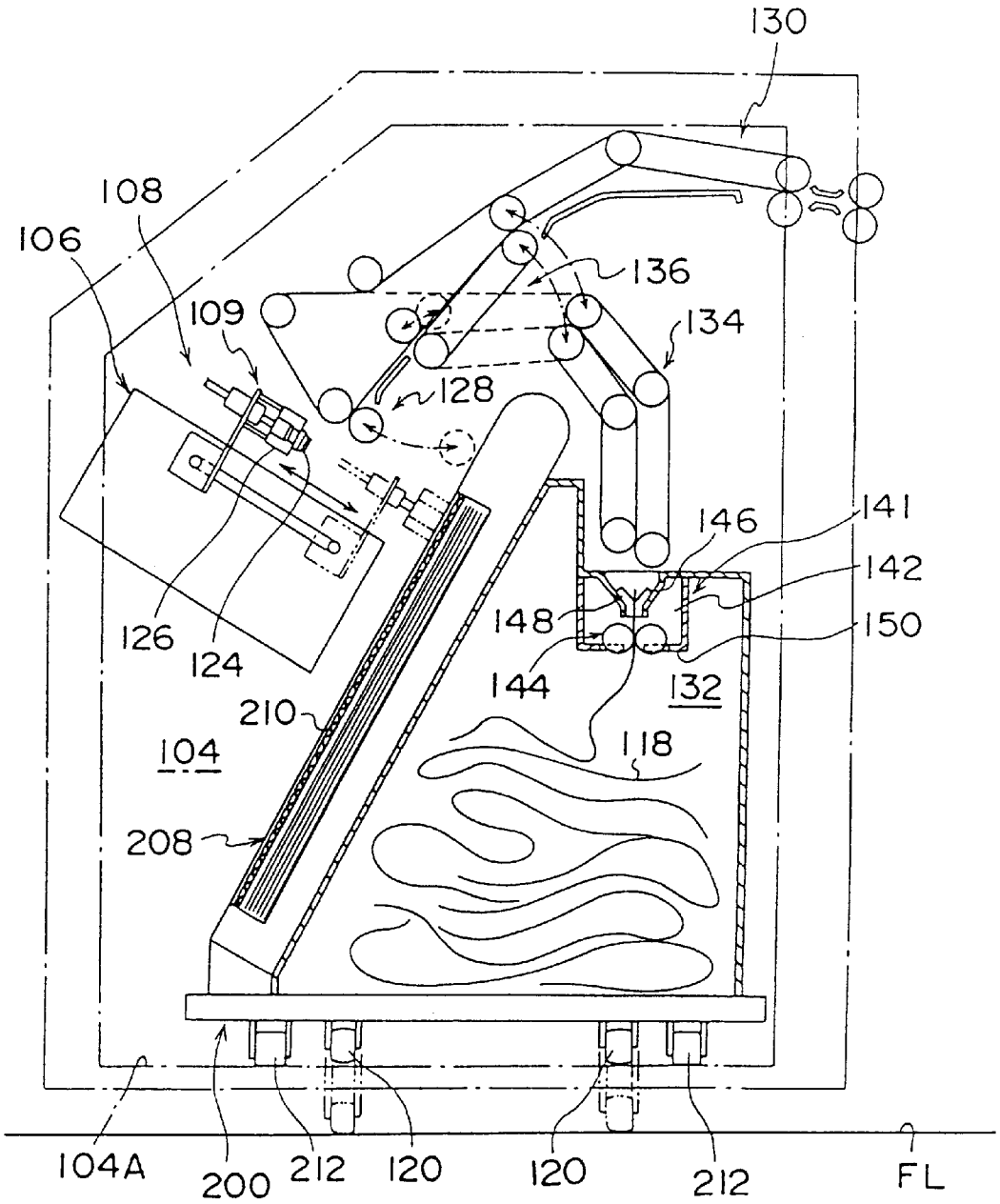
FIG. 3 is a side view of a plate feed section according to the first embodiment of the present invention.

As shown in FIG. 3, the plate accommodating section 104 is provided with a magazine 208 in which a plurality of photopolymer plates 102 are accommodated, and thereafter, a trolley 200, a detailed description of which will be given later, can be accommodated in the plate accommodating section 104. As shown in FIG. 2, one protective interleaf sheet 118 is provided at the surface of each photopolymer plate 102 accommodated in the magazine 208. Thus, the photopolymer plates 102 and the interleaf sheets 118 are in an alternately stacked state.

Figure 4:
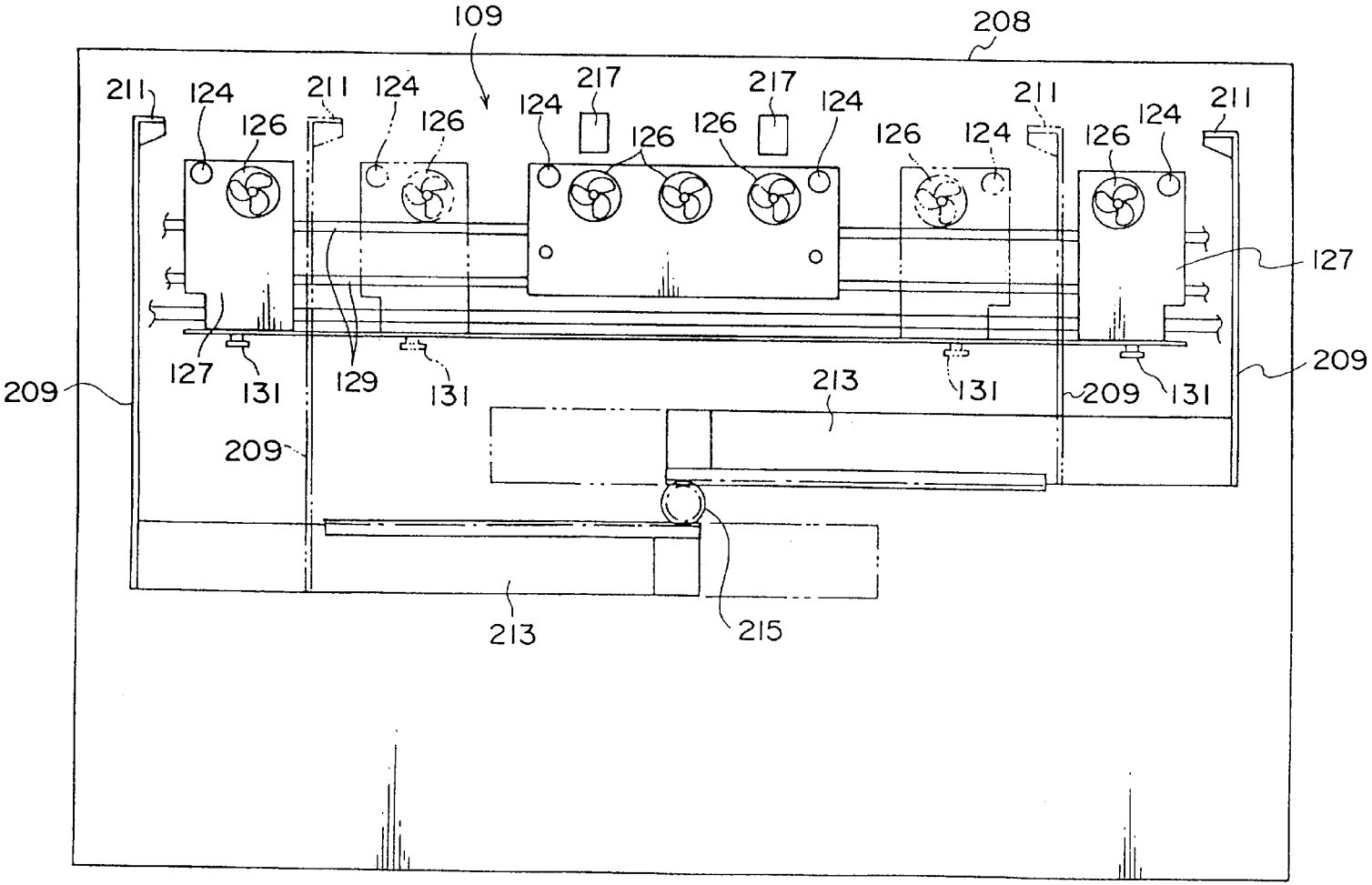
FIG. 4 is a plan view illustrating a relationship among the suckers, suction fans, guide plates, separating plates, and interleaf sheet pressing plates, of a suction transport device according to the first embodiment of the present invention.

As shown in FIG. 4, the magazine 208 is provided with a pair of guide plates 209 for forming a part of the suction transport device 109 and for defining the widthwise direction both end portions of the photopolymer plates 102 and the interleaf sheets 118 accommodated in the magazine 208. Further, to the leading end portions of the guide plates 209, are mounted separating plates 211 which correspond to the leading end corner portions of the photopolymer plates 102 and the interleaf sheets 118 accommodated in the magazine 208. A function of the separating plates 211 is to engage with a photopolymer plate 102, curve the leading end corner portions of the photopolymer plate 102, and peel the same from an interleaf sheet 118 when the photopolymer plate 102 is taken out from the magazine 208 by a suction mechanism which will be described later.

These guide plates 209 and the separating plates 211 can move in accordance with one another in the widthwise direction of the photopolymer plates 102 which are accommodated in the magazine 208. Namely, as shown in FIG. 4, rack bars 213, which are disposed so as to oppose each other, are connected to the guide plates 209, respectively. The rack bars 213 have a common pinion 215 which meshes therewith. Thus, the guide plates 209 have a structure such that, when a guide plate 209 is moved, the other moves in accordance with the latter in a similar manner. Accordingly, in cases in which the photopolymer plates 102 and the interleaf sheets 118 of a different size are accommodated in the magazine 208, the guide plates 209 and the separating plates 211 can be provided at an optimum position that corresponds to the photopolymer plates 102 and the interleaf sheets 118 to be accommodated in the magazine 208.

The magazine 208 is provided with interleaf sheet pressing plates 217. The interleaf sheet pressing plates 217 are provided so as to correspond to an interleaf sheet 118 on top of each of the photopolymer plates 102 top surface, which are accommodated in the magazine 208. A function of the interleaf sheet pressing plates 217 is to engage with an interleaf sheet 118 and hold the same when a photopolymer plate 102 is taken out from the magazine 208 by the suction mechanism which will be described later. Further, the interleaf sheet pressing plates 217 are provided fixedly so as to correspond to the widthwise direction central portion of the photopolymer plates 102 (at a position facing suction mechanisms which are located at the central portion thereof and which will be described later).

The plate accommodating section 104, which accommodates the trolley 200 which is provided with the magazine 208, has a floor portion 104A which is formed at a higher position than a track surface. The trolley 200 is a structure that lifts from the track surface to the floor portion 104A. That is, the trolley 200 is supported relative to the track surface by casters 120, which casters 120 can each be moved relative to the trolley 200 between an extended position (a position shown by broken lines in FIG. 3) and a accommodating position (a protruding position shown by solid lines in FIG. 3).

In accordance with an accommodating movement to the plate accommodating section 104, the casters 120 move so as to fold upwards into the accommodated position and, at the same time, help rollers 212 correspond to the floor portion 104A. Subsequently, the trolley 200 is supported relative to the floor portion 104A by the help rollers 212.

A sheet delivery section 106 is provided at the upper portion of the plate accommodating section 104. The sheet delivery section 106 alternately takes photopolymer plates 102 and interleaf sheets 118 from the stacked state thereof and passes them onto the plate feed section 108. The sheet delivery section 106 is provided with a sucker 124 as one of the suction mechanisms which sucks the photopolymer plates 102 and the interleaf sheets 118. Further, an unillustrated vacuum pump, which supplies a negative pressure into the sucker 124, is connected to the sucker 124 so as to suck printing plates and the interleaf sheets. Moreover, in the vicinity of the sucker 124 but separate from the sucker 124, a suction fan 126 is provided, which functions as an auxiliary suction mechanism when one of the interleaf sheets 118 is being sucked. As shown in FIG. 4, a plurality of suckers 124 and suction fans 126 are disposed at positions opposing the photopolymer plates 102 and the interleaf sheets 118 in the widthwise direction thereof.

Among the plurality of these suckers 124 and suction fans 126, those located at the central portion thereof are provided fixedly and as described above, are located so as to oppose the interleaf sheet pressing plates 217 of the magazine 208.

Figure 5:
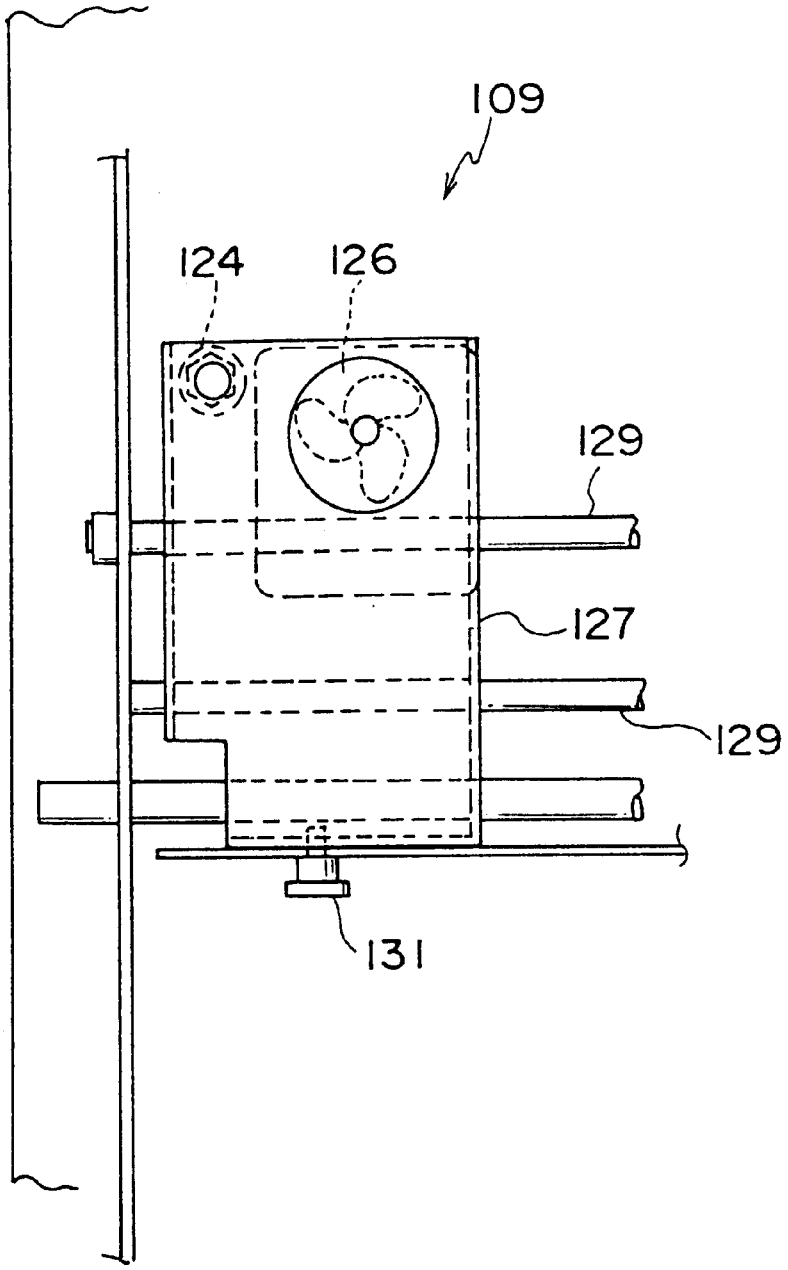
FIG. 5 is a plan view illustrating a structure of the suckers and the suction fans of the suction transport device according to the first embodiment of the present invention.
Figure 6:
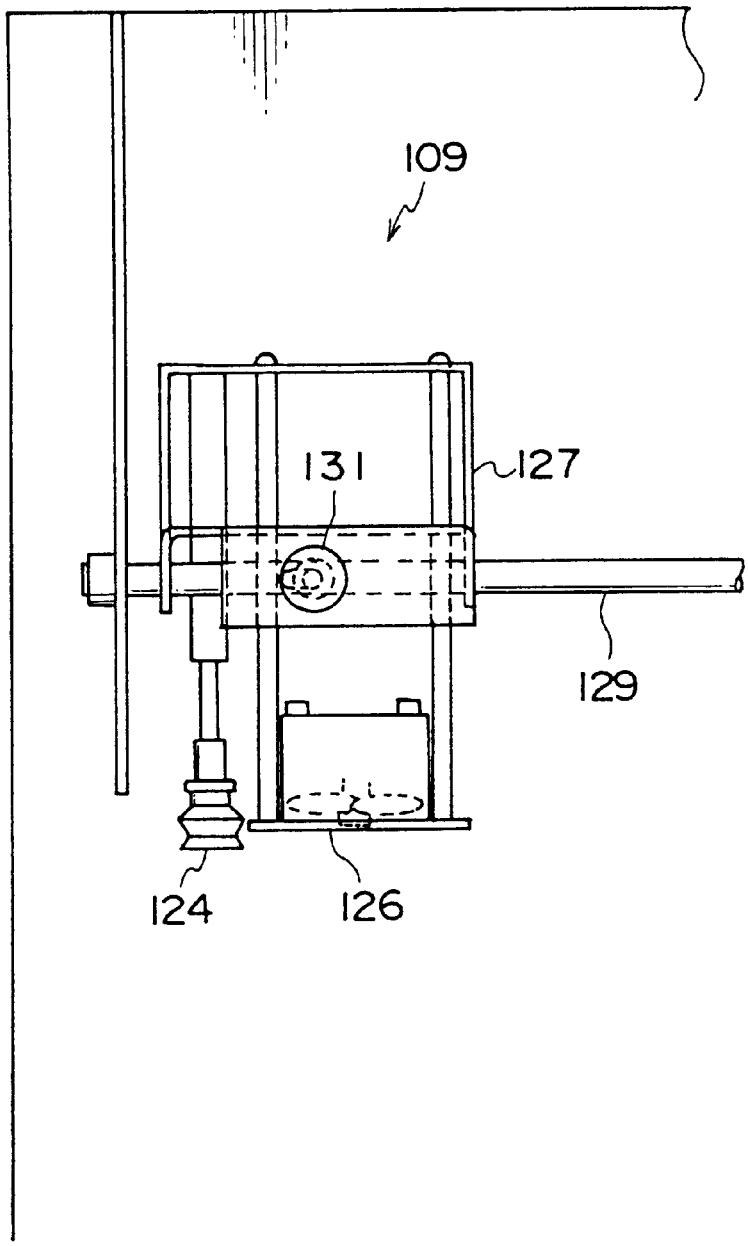
FIG. 6 is a front view illustrating structures of the suckers and the suction fans, of the suction transport device according to the first embodiment of the present invention.

The sucker 124 and the suction fans 126, which are located at widthwise direction both sides of the photopolymer plates 102 and the interleaf sheets 118, are provided so as to be movable in the widthwise directions of the photopolymer plates 102 and the interleaf sheets 118. Namely, as shown in FIGS. 5 and 6, the suckers 124 and the suction fans 126 located at the aforementioned widthwise direction both sides are integrally mounted to brackets 127. Further, the brackets 127 are slidably supported by guide rails 129. Moreover, each of the brackets 127 has a fixing screw 131. The fixing screw 131 is loosened or fastened so that the suckers 124 and the suction fans 126 located at the brackets 127 side, that is, at the widthwise direction both sides of the photopolymer plates 102 and the interleaf sheets 118, can move to an arbitrary position and be fixed at a predetermined position.

The sucker 124 and the suction fan 126 thus structured can be moved closer to or further from the surface of the stack of interleaf sheets 118 and photopolymer plates 102 which are accommodated in the magazine 208 in a stacked state.

When a photopolymer plate 102 is to be sucked, the sucker 124 makes contact with the photopolymer plate 102, and sucks the same due to an operation of an unillustrated vacuum pump. However, when an interleaf sheet 118 is to be sucked, the suction fan 126 is disposed at a short distance from the interleaf sheet 118 (a housing of the suction fan 126 can make contact with the interleaf sheet 118) and the suction fan 126 operates alone such that only the lightweight, thin interleaf sheet 118 is sucked up. Subsequently, the sucker 124 begins to operate. Hence, when the interleaf sheet 118 is sucked, double suction (sucking the photopolymer plate 102 that is underneath together with the interleaf sheet 118) is prevented.

The major portions forming the plate feed section 108 are a common transport section 128, a photopolymer plate transport section 130, an interleaf sheet transport section 134, and a switching transport section 136. The common transport section 128 receives the photopolymer plates 102 or the interleaf sheets 118 from the aforementioned sheet delivery section 106. The photopolymer plate transport section 130 receives the photopolymer sheets 102 and passes the same onto the surface plate 110. The interleaf sheet transport section 134 receives the interleaf sheets 118 and passes the same onto an interleaf sheet accommodating section 132 (mounted at the trolley 200). The switching transport section 136 switches to guide a photopolymer plate 102 or interleaf sheet 118 from the common transport section 128 to one of the photopolymer plate transport section 130 and the interleaf sheet transport section 134.

The photopolymer plates 102 and the interleaf sheets 118 are alternately stacked. Therefore, the switching transport section 136 switches each time the sheet delivery section 106 sucks, and the plate feed section 108 is a structure that transports the photopolymer plates 102 and the interleaf sheets 118 respectively in predetermined directions.

Figure 7A:
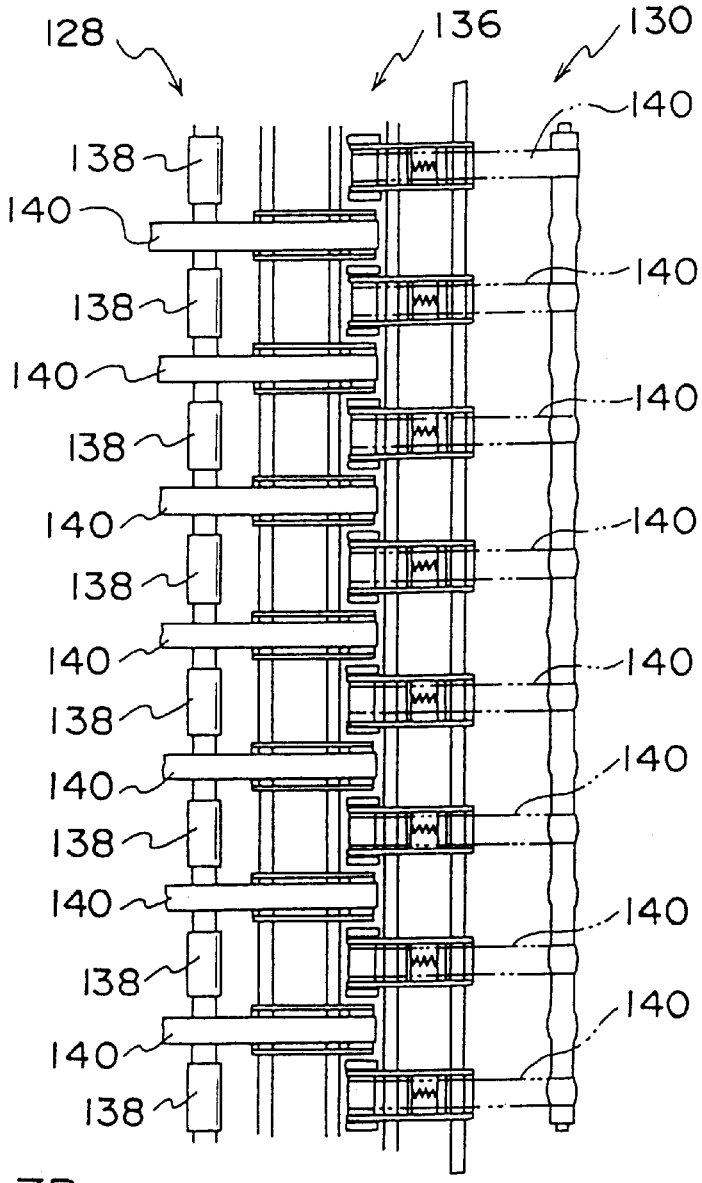
FIG. 7A is a plan view illustrating a portion of a transport system of the plate feed section according to the first embodiment of the present invention.
Figure 7B:
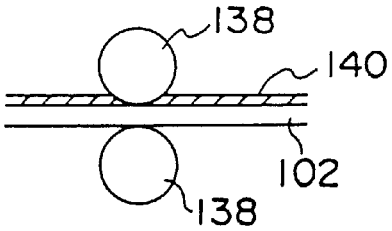
FIG. 7B is a side view of a common transport section, a photopolymer plate transport section, and a switching transport section.

As shown in FIG. 7A, at the common transport section 128, the photopolymer plate transport section 130 and the switching transport section 136, skewered rollers 138 and narrow belts 140 are combined to form a transport system, whose main purpose is transporting the photopolymer plates 102 (see FIG. 7B). The photopolymer plates 102 are transported by a strong gripping force of the skewered rollers 138, and the narrow belts 140 serve as moving guide plates during transport.

Figure 7C:
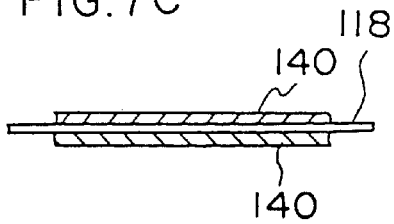
FIG. 7C is a side view of an interleaf sheet transport section.

At the interleaf sheet transport section 134, however, narrow belts 140 alone form a transport system, as shown in FIG. 7C. In this structure, the interleaf sheets 118 are transported by a weak gripping force of the narrow belts 140.

Figure 8:
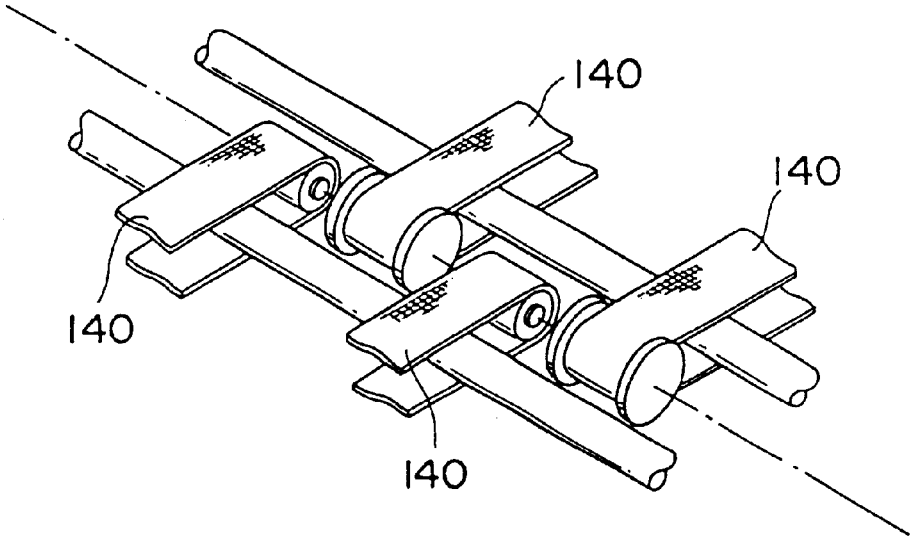
FIG. 8 is a perspective view illustrating a hand-over portion of a different transport system of the plate feed section according to the first embodiment of the present invention.

As shown in FIG. 8, the hand-over portion between two transport sections is in a skewered shape with end portions of the transport sections protruding respectively alternately, such that where one transport section protrudes the other recedes, and vice versa. Thus, the two transport sections intermesh from opposite sides (with narrow belt end portion support rollers having a common axis). Therefore, at a time of hand-over of one of the photopolymer plates 102 or one of the interleaf sheets 118, wrapping thereof around the skewered rollers 138 and the narrow belts 140 is prevented.

As shown in FIG. 3, the interleaf sheets 118 that are transported by the interleaf sheet transport section 134 are guided, by a sheet material enforcement stacking device 141, to the interleaf sheet accommodating section 132 as a means of an accommodation section provided at the trolley 200.

Figure 9:
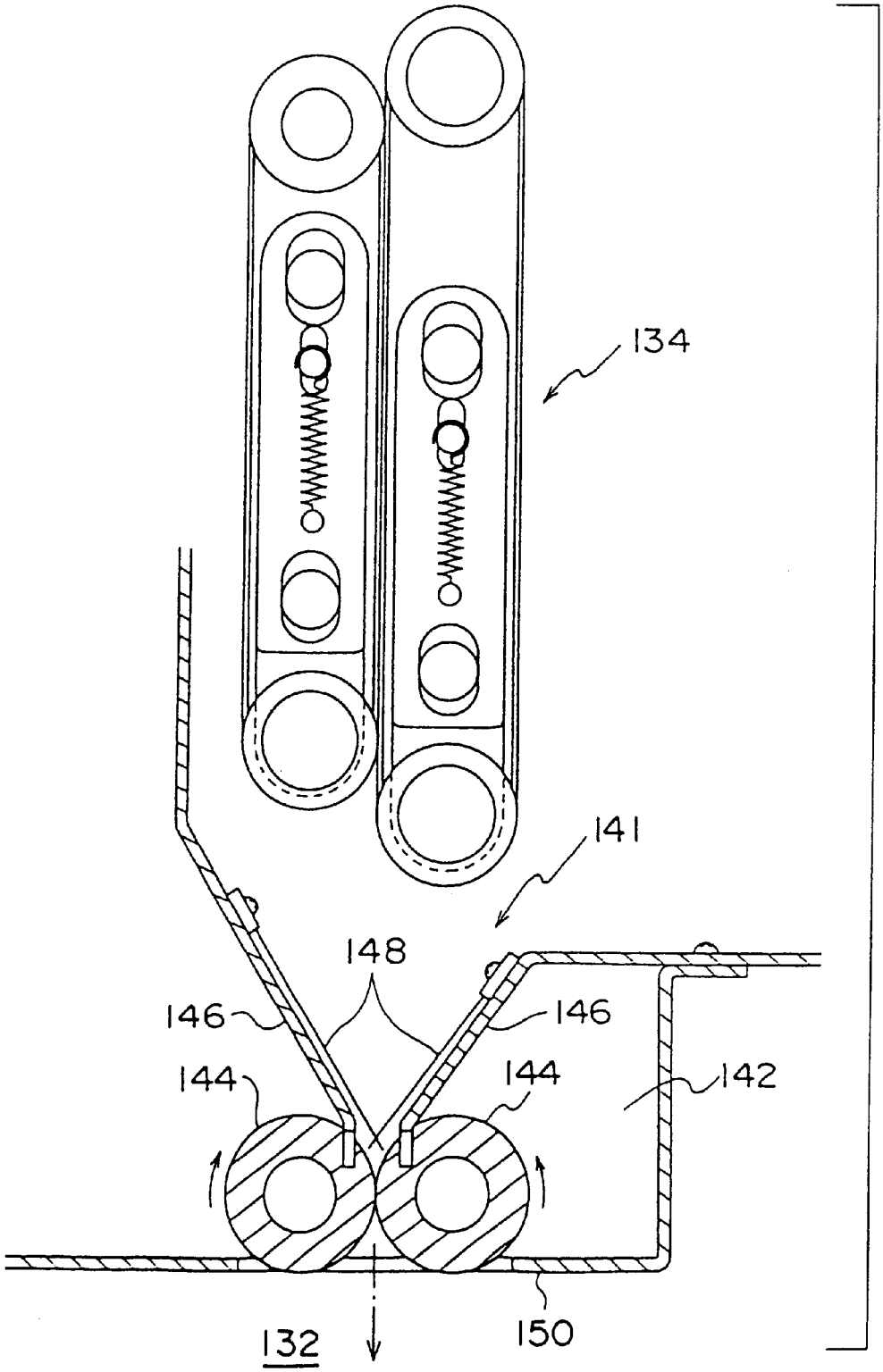
FIG. 9 is a cross-sectional view illustrating details of a sheet material enforcement stacking device according to the first embodiment of the present invention.

FIG. 9 shows details of the sheet material enforcement stacking device 141.

Figure 10:
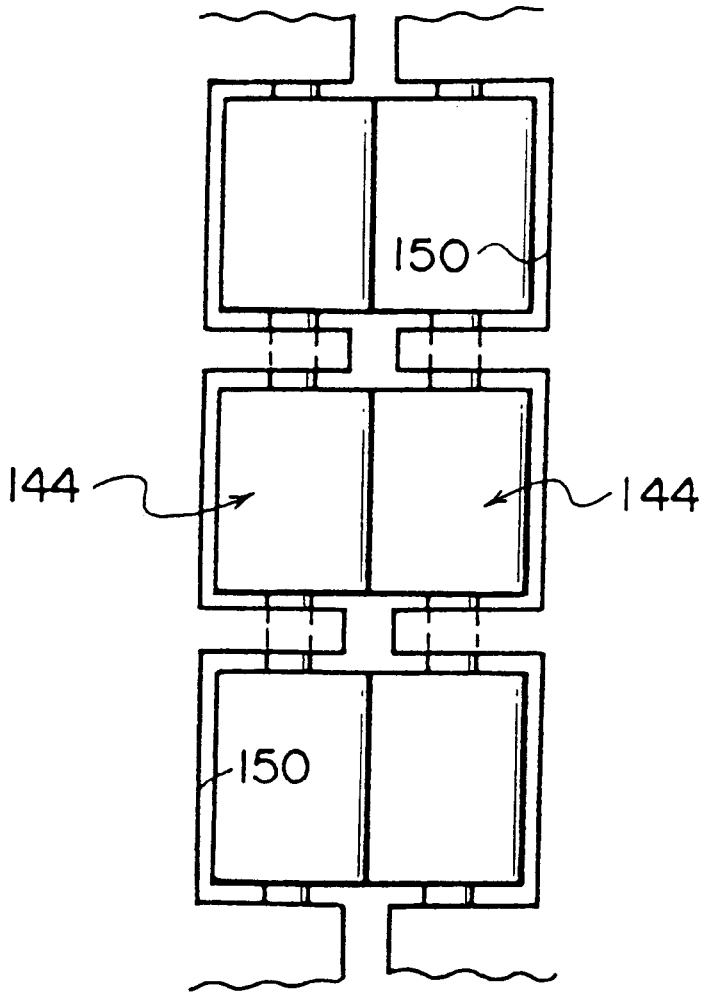
FIG. 10 is a plan view illustrating rollers and a wrap-around prevention board of the sheet material enforcement stacking device according to the first embodiment of the present invention.

At the sheet material enforcement stacking device 141, a pair of rollers 144 are provided at an insertion slot 142 of an interleaf sheet 118, which insertion slot 142 is provided at the upper portion of the interleaf sheet accommodating section 132. As shown in FIG. 10, the pair of the rollers 144 are formed in a skewered shape, and rotarily driven at a linear speed slightly faster than the speed of the interleaf sheet transport section 134 (about 1.1 times as fast). Thus, when one of the interleaf sheets 118 passes down between the rollers 144, the interleaf sheet 118 maintains a state of predetermined tension (as a so-called stronger pulling tension) as it is transported, and jamming due to slackness or the like can be prevented.

Further, at the interleaf sheet transport section 134 side of the insertion slot 142, guide plates 146 are provided which gradually taper to reduce the width therebetween (which width is in the direction of thickness of the interleaf sheets 118) and which face each other. At the thus tapered guide plates 146 facing each other, anti-static brushes 148 are respectively attached, which anti-static brushes 148 remove electric charge from the interleaf sheets 118 that are inserted into the insertion slot 142.

Wrap-around prevention boards 150 are provided at the lower portion of the pair of the rollers 144 such that edges of the wrap-around prevention boards 150 follow along projections and indentations of each of these skewered shapes of the rollers 144. Hence, after the interleaf sheets 118 have passed through between the rollers 144 and have been accommodated in the interleaf sheet accommodating section 132, even if a part of one of the accommodated interleaf sheets 118 touches one of the rollers 144, the respective wrap-around prevention board 150 can prevent the interleaf sheet 118 from wrapping around that roller 144.

As shown in FIG. 1, the one of the photopolymer plates 102 transported by the photopolymer plate transport section 130 leaves the photopolymer plate transport section 130 in a horizontal state and is handed over to the surface plate 110.

Figure 11A:
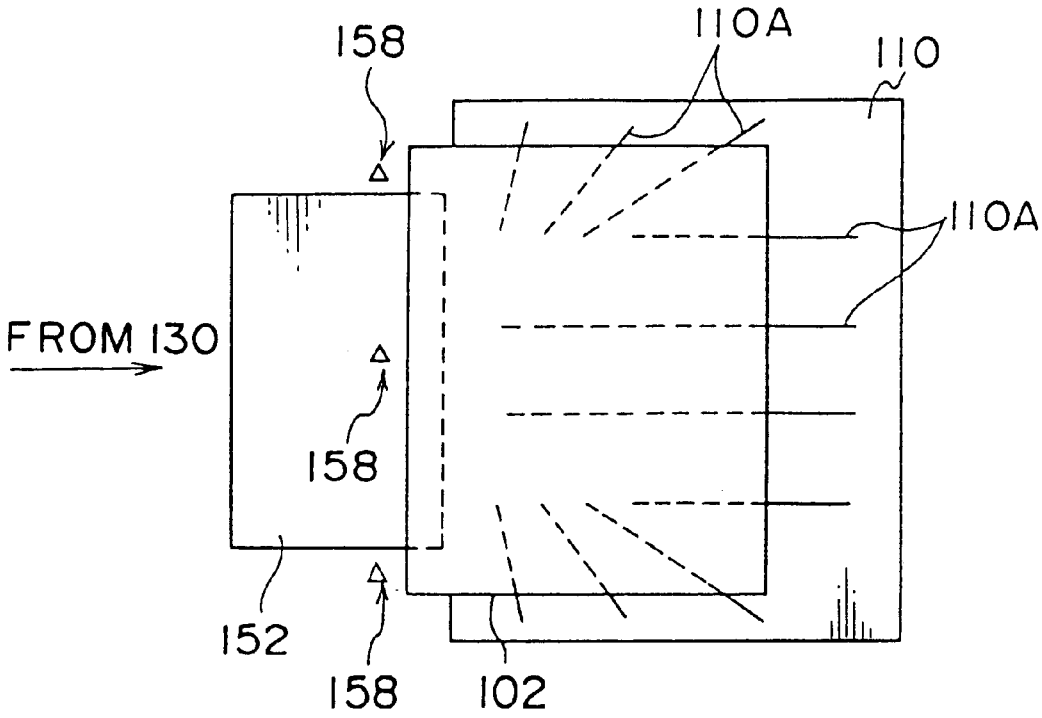
FIG. 11A is a plan view of a surface plate according to the first embodiment of the present invention.
Figure 11B:
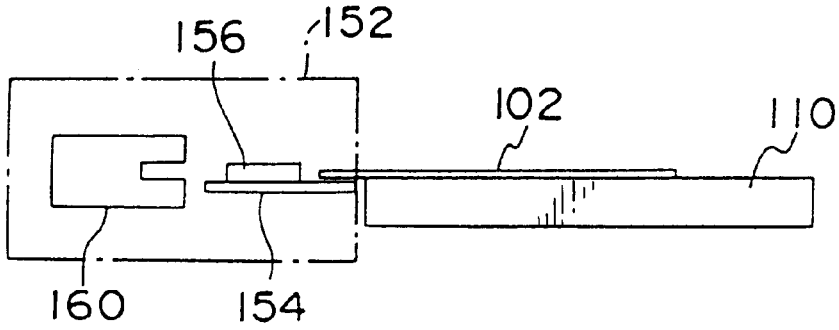
FIG. 11B is a side view of the surface plate according to the first embodiment of the present invention.

A top surface height of the surface plate 110 is at a lower position than the height of horizontal transport from the photopolymer plate transport section 130, and slightly separated therefrom in the transport direction. Therefore, when discharged from the photopolymer plate transport section 130, the photopolymer plate 102 hangs down slightly when landing on the surface plate 110, and the transport direction back end of the photopolymer plate 102 is disposed in a position further toward the photopolymer plate transport section 130 side than the surface plate 110. As shown in FIG. 11, a temporary support arm 154, which is provided at a discharging mechanism section 166 which will be described later, is disposed at the photopolymer plate transport section 130 side of the surface plate 110 so as to prevent the photopolymer plate 102 from hanging down.

In the vicinity of the temporary support arm 154, is provided a moving body 152 which can move toward or away from the surface plate 110. At the moving body 152, is provided a pushing plate 156 which pushes the back end of the photopolymer plate 102 in the transport direction. As the back end of the photopolymer plate 102 is pushed by the pushing plate 156, obliqueness of the photopolymer plate 102 is substantially eliminated and the photopolymer plate 102 can be moved to a predetermined standard position in the transport direction. When the photopolymer plate 102 is at this standard position, the transport direction back end portion thereof is in a state in which it projects slightly from the surface plate 110.

At this standard position, sensors 158 are provided at a plurality of positions, including both corner portions of the transport direction back end portion of the photopolymer plate 102. When the sensors 158 detect the transport direction back end portion of the photopolymer plate 102, the push of the pushing plate 156 is stopped. Further, the sensors 158 are also used for position detection of the widthwise transport direction of the photopolymer plate 102. That is, the surface plate 110 moves in the widthwise transport direction of the photopolymer plate 102 to make the sensors 158 and the corners of the photopolymer plate 102 correspond. This position is recorded as an initial position of the photopolymer plate 102.

The photopolymer plate 102, which has been moved to the initial position, is positioned relative to an exposure scanning start position in an exposure section 112. The photopolymer plate 102 is held in this state by suction from suction channels 110A which are provided at the surface plate 110.

Punch holes are provided at the photopolymer plate 102, which is being held by suction, by a puncher 160 which is provided at the aforementioned moving body 152.

Further, in order to be positioned in a direction transverse to the transport direction, the surface plate 110 can move at a uniform velocity in both directions between a first position, at which the surface plate 110 receives the photopolymer plate 102 from the photopolymer plate transport section 130, (see the position shown by solid lines in FIG. 1) and a second position, at which the surface plate 110 is accommodated at the exposure section 112 (see the position shown by broken lines in FIG. 1).

At the exposure section 112, a scanning unit 164 is provided above a transport path of the surface plate 110. A laser beam, whose light is controlled according to an image signal, forms a main scanner (in a direction orthogonal to a transport direction of the surface plate 110). Outward transport of the surface plate 110 (toward the exposure section 112) is a sub-scanning movement. Thus, at the exposure section 112, an image is recorded onto the photopolymer plate 102 on the surface plate 110 at the time of the outward transport. The surface plate 110 is returned to an original position by return transport (away from the exposure section 112). Then, after the photopolymer plate 102 on the surface plate 110 has been returned to the original position, the suction holding the photopolymer plate 102 is released.

After the surface plate 110, on which the photopolymer plate 102 having an image recorded thereon has been placed, returned to its original position, in order to correspond to the original position of the surface plate 110, a discharging mechanism section 166 is provided at the side of the photopolymer plate transport section 130 where the photopolymer plate 102 transport direction back end is disposed (at the moving body 152 side).

Figure 12A:
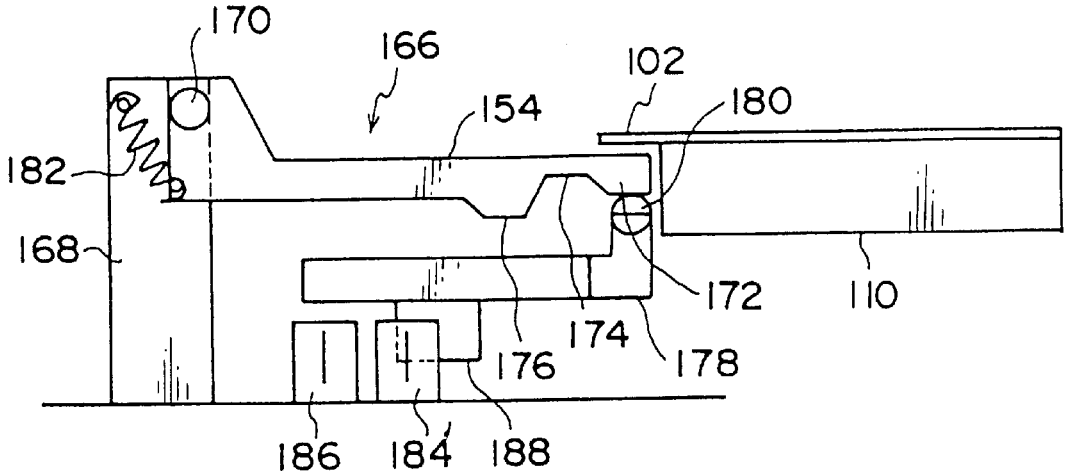
FIGS. 12A to 12C are side views illustrating the movement of a discharging mechanism section according to the first embodiment of the present invention.
Figure 12B:
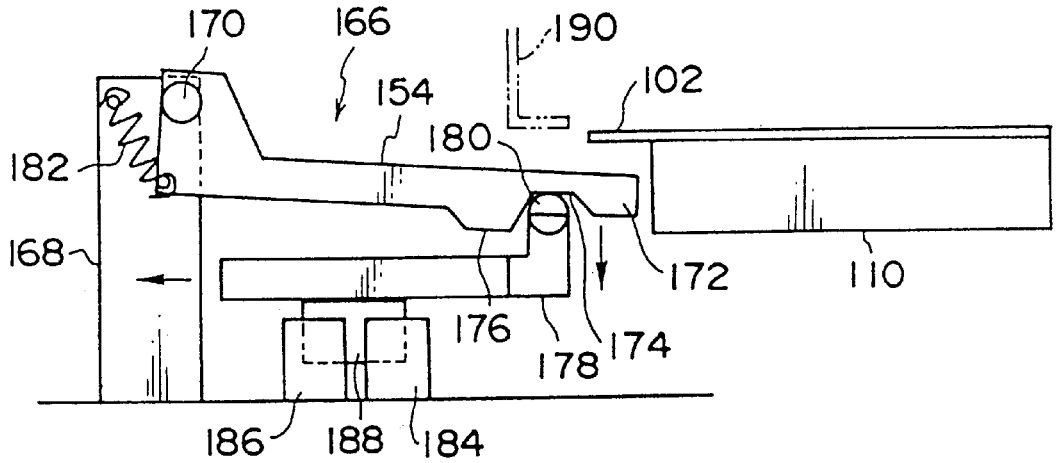
Figure 12C:
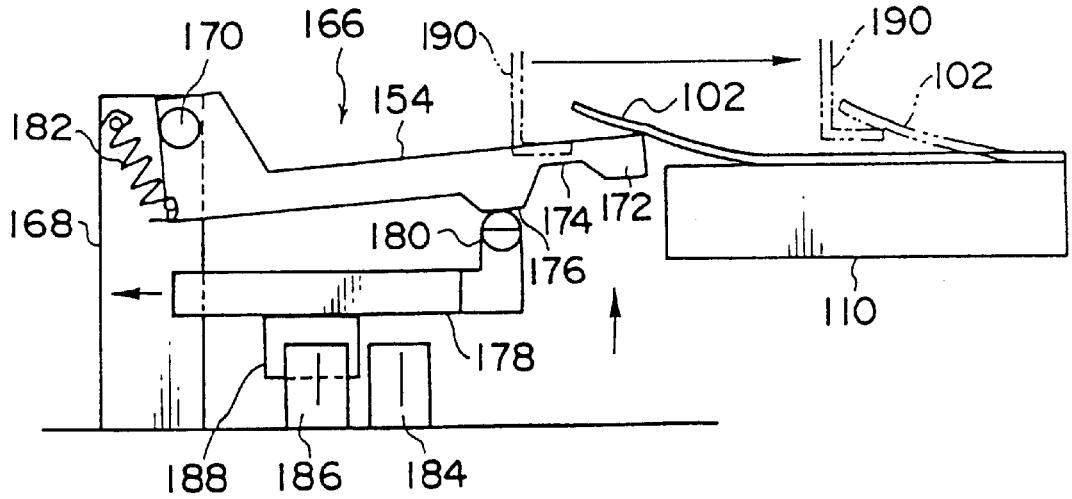

FIGS. 12A to 12C show schematic side views of the structure of the discharging mechanism section 166. At the discharging mechanism section 166, the aforementioned pair of the temporary support arms 154 are supported rotarily relative to a stage base 168 through a support shaft 170. The tip end portions of the pair of the temporary support arms 154 are located in the vicinity of the surface plate 110. At the lower surface side of each of the temporary support arms 154, are formed a convex portion 172, a concave portion 174, and a convex portion 176 whose height (depth) dimensions differ.

A moving stage 178 is provided underneath the temporary support arm 154. The moving stage 178 can move along the temporary support arm 154, and at the tip end thereof, a roller 180 is provided and abuts the lower surface of the temporary support arm 154. Therefore, as the moving stage 178 moves, the position of abut and support of the roller 180 relative to the temporary support arm 154 changes (to a position of the convex portion 172, the concave portion 174, or the convex portion 176). Accordingly, the moving stage 178 is a structure in which the height position of the tip end portion of the temporary support arm 154 changes. Further, a spring 182 is connected to the back end portion of the temporary support arm 154 so that the temporary support arm 154 always follows the movement of the moving stage 178.

When the roller 180 is in a state in which it abuts and supports the convex portion 172 as shown in FIG. 12A, the temporary support arm 154 is located at a horizontal position which is at the same height as the surface plate 110 top surface. When the roller 180 is in a state in which it abuts and supports the convex portion 174 as shown in FIG. 12B, the temporary support arm 154 is at a withdrawn position which is lower than the surface plate 110 top surface. When the roller 180 is in a state in which it abuts and supports the convex portion 176 as shown in FIG. 12C, the temporary support arm 154 is at a pushed-up position which is higher than the surface plate 110 top surface. Thus, the dimensions of each of the convex portion 172, the concave portion 174, and the convex portion 176 is thereby determined. In this way, since the roller 180 of the moving stage 178 abuts the convex portion 172 of the temporary support arm 154, and the temporary support arm 154 is at a horizontal position which has the same height as the surface plate 110 top surface, the photopolymer plate 102 on top of the surface plate 110 can be prevented from hanging down. Further, the roller 180 of the moving stage 178 is a structure that abuts the convex portion 176 of the temporary support arm 154 so that the temporary support arm 154 is located at the pushed-up position which is higher than the surface plate 110 top surface, thus lifting up the back end portion of the photopolymer plate 102 on top of the surface plate 110.

A pair of sensors 184 and 186 are disposed underneath the moving stage 178. These sensors 184 and 186 can detect a position of the moving stage 178, i.e., a position of the temporary support arm 154 by detecting a dog 188. That is, due to the structure of these sensors 184 and 186, it is found that: in a state in which only the sensor 184 detected the dog 188, the temporary support arm 154 is located at the horizontal position which is the same height as the surface plate 110 top surface; in a state in which both sensors 184 and 186 detected the dog 188, the temporary support arm 154 is at the withdrawn position which is lower than the surface plate 110 top surface; and in a state in which only the sensor 186 detected the dog 188, the temporary support arm 154 is at the pushed-up position which is higher than the surface plate 110 top surface.

Figure 13:
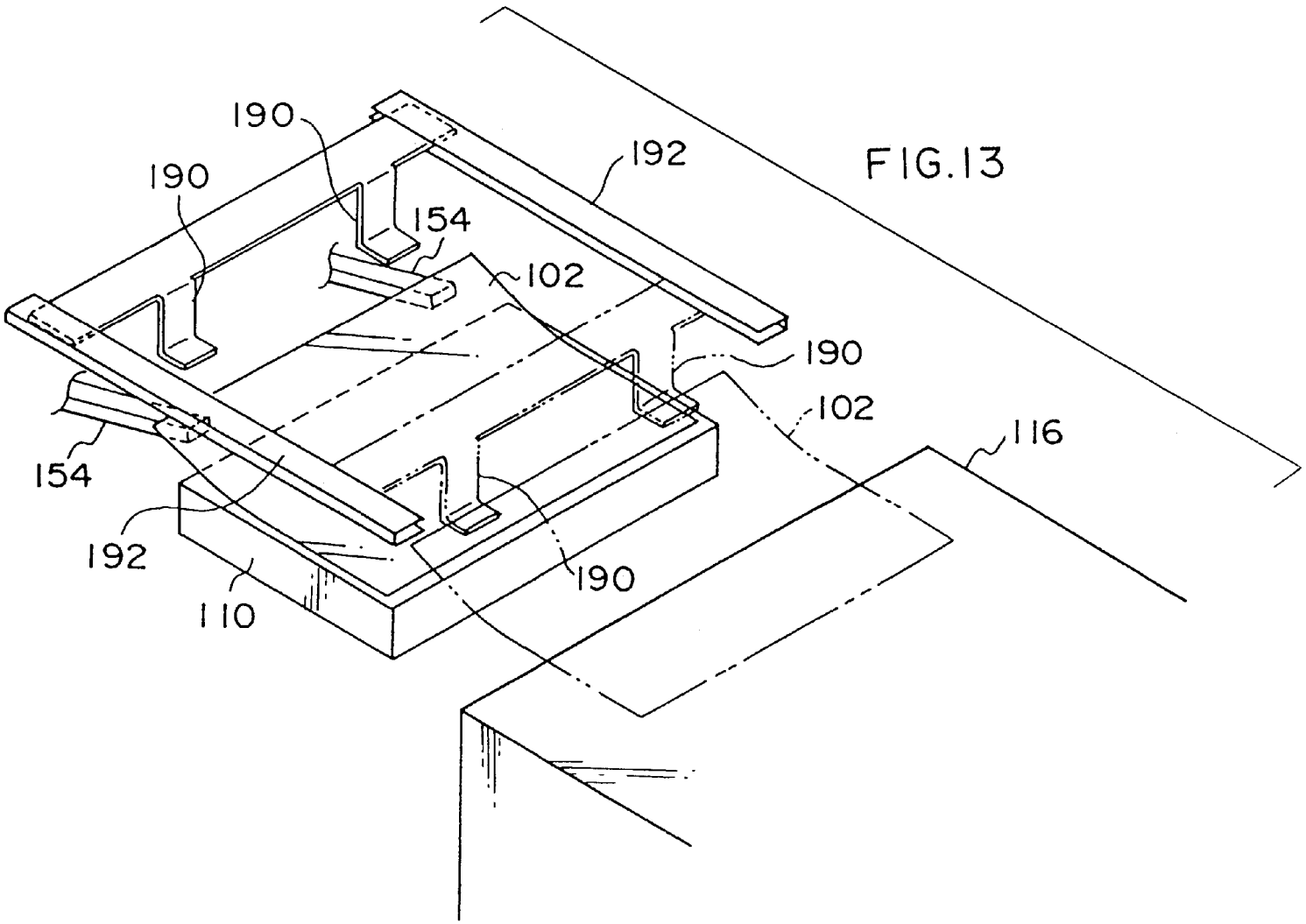
FIG. 13 is a perspective view illustrating plate discharging pawls of the discharging mechanism section according to the first embodiment of the present invention.

On the other hand, at the discharging mechanism section 166, a pair of plate discharging pawls 190 are provided above the temporary support arm 154. As shown in FIG. 13, this pair of plate discharging pawls 190 can move along guide rails 192 disposed along the surface plate 110. That is, the plate discharging pawls 190 pass over the surface plate 110 and move toward the transport direction front end portion of the photopolymer plate 102.

These plate discharging pawls 190 are structured such that, in a state in which the photopolymer plate 102 back end portion that protrudes from the surface plate 110 as described above is lifted up by the temporary support arm 154, the photopolymer plate 102 can be engaged by the plate discharging pawls 190 moving in the photopolymer plate 102 transport direction. Therefore, the photopolymer plate 102 engaged by the plate discharging pawls 190 is a structure that is transported to a downstream side of the surface plate 110 in accordance with the movement of the plate discharging pawls 190.

At the aforementioned downstream side of the surface plate 110, a buffer section 114 and an automatic development device 116 are provided. The buffer section 114 absorbs a difference between a discharge speed of the discharging mechanism section 166 and a transport speed of the automatic development device 116, and delivers the photopolymer plates 102 smoothly.

(Detailed Structure of the Trolley 200).

Figure 14:
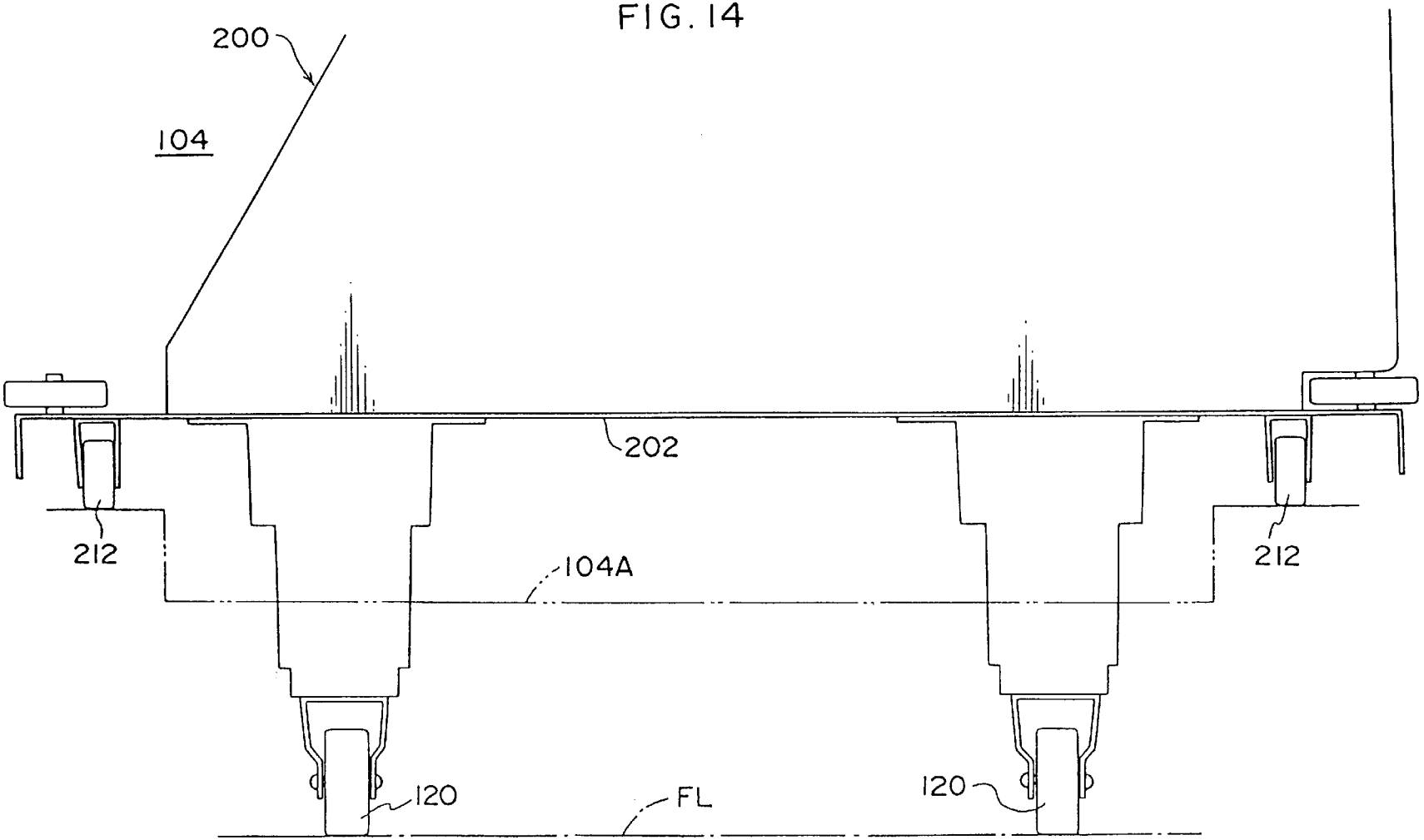
FIG. 14 is an enlarged side view of a lower portion of a trolley according to the first embodiment of the present invention.

The trolley 200 is shown in FIGS. 1 and 14. The trolley 200 has a loading platform 202, which is supported at a track surface FL via the four casters 120 (only two of which are shown in FIG. 14). A handle 204 (see FIG. 1) is attached at the loading platform 202. The handle 204 is substantially curved in a U shape. Both ends of the handle 204 are fixed so as to protrude and abut the loading trolley 202.

An accumulation section 206, which holds the stacked photopolymer plates 102, is provided at the loading trolley 202. Viewed from the side, this accumulation section 206 is substantially in the form of a right-angled triangle. The above-described magazine 208, which accommodates the photopolymer plates 102, is propped up at a slanted surface portion of the accumulation section 206.

At the magazine 208, a plurality of photopolymer plates 102 are stacked in advance. Further, a shutter 210 is provided at the magazine 208. Except when in a darkroom, this shutter 210 is left in a closed state to prevent exposure of the photopolymer plates 102.

That is, the trolley 200 can convey the photopolymer plates 102 between the aforementioned accommodating section 104 and a darkroom in which the photopolymer plates 102 are accommodated, and the shutter 210 can protect the photopolymer plates 102 during conveyance.

The side of the trolley 200 to which the handle 204 is attached faces backward at a time of conveyance. The handle 204 is accommodated at the plate accommodating section 104.

As shown in FIG. 14, the plate accommodating section 104 is a box-shaped space that has the floor portion 104A which is formed at a higher position than the track surface FL. The trolley 200 is accommodated at this floor portion 104A by being supported thereat. At that time, the casters 120 of the trolley 200 are folded and supported by a plurality of the help rollers 212 (six in the present embodiment) which are mounted to the bottom surface of the loading platform 202.

Figure 15:
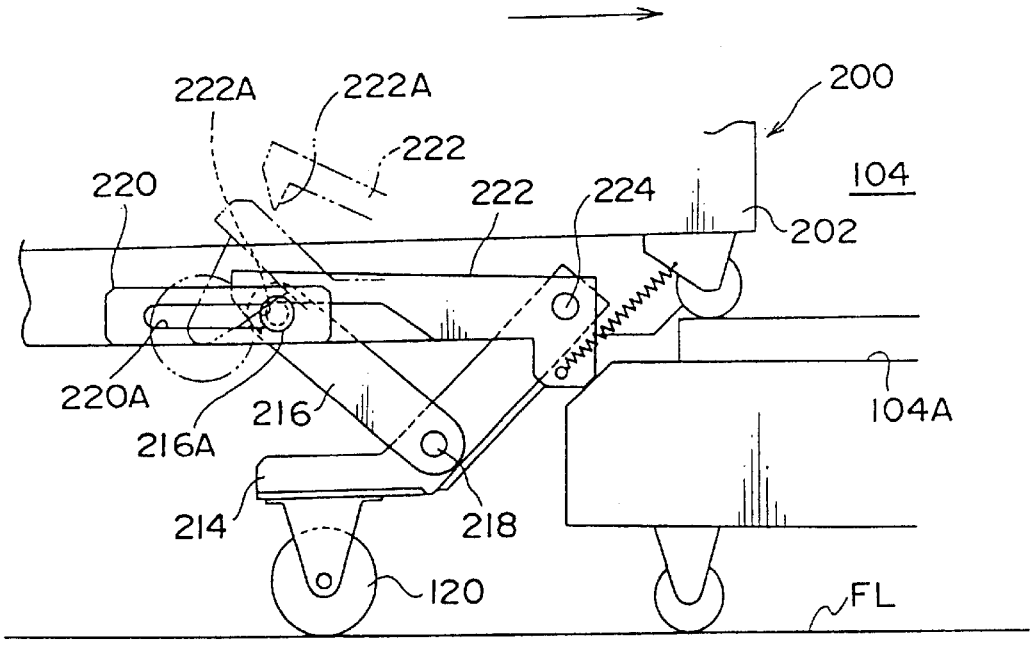
FIG. 15 is a side view illustrating the structure of an accommodating mechanism section of casters according to the first embodiment of the present invention.

Folding movement of the casters 120 is carried out in accordance with the accommodating movement of the trolley 200 at the plate accommodating section 104. As shown in FIG. 15, the casters 120 are mounted to one end of a main arm 214 whose other end is rotatably supported. One end of a supporting arm 216 is rotatably supported at a lengthwise direction interleaf portion of the main arm 214 via a shaft 218. To the other end of the supporting arm 216 is mounted a slide pin 216A. The slide pin 216A is accommodated in an elongated hole 220A of the fixed rail arm 220.

In an ordinary fixed state of the casters 120, the slide pin 216A is engaged by a hook portion 222A which is formed at one end portion of an L-shaped arm 222, and is a structure that is held in the vicinity of one end portion of the elongated hole 220A.

The bent portion of the L-shaped arm 222 is supported via a rotating shaft 224 of the main arm 214. The other end portion of the L-shaped arm 222 is disposed at a position that abuts the end surface of the floor portion 104A of the plate accommodating section 104.

When the other end portion of the L-shaped arm 222 in a state in which it abuts the end surface of the floor portion 104A is further pushed, the L-shaped arm 222 rotates around the rotating shaft 224 so as to disengage the hook portion 222A from the slide pin 216A.

Since due to this disengagement, the supporting arm 216 to which the slide pin 216A is mounted is moved to the other end portion of the elongated hole 220A by an urging force of an urging means, the main arm 214 is lifted up in accordance with the movement of the elongated hole 220A, and the casters 200 separate from the track surface. Further, the trolley 200 at this time is supported on the floor portion FL via the above-described help rollers 212.

An operation of the first embodiment of the present invention is described below.

In a case in which the photopolymer plates 102 are accommodated at the plate accommodating section 104 of the automatic exposure device 100, the trolley 200, together with the photopolymer plates 102, is accommodated at the plate accommodating section 104 so that the photopolymer plates 102 can be positioned at a predetermined position.

Because the photopolymer plates 102 are being stored in a darkroom which is away from the automatic exposure device 100, an operator pushes the trolley 200 to the darkroom where the operator mounts the photopolymer plates 102 in a unit of the magazine 208 at a predetermined position (accumulation section 206) of the trolley 200. At this time, the shutter of the magazine 208 is left closed.

When the operator finishes the mounting of the magazine 208, the operator again conveys the trolley 200 to the automatic exposure device 100, opens an open-close cover (equipped at the trolley 200 side in FIG. 3), and stores the trolley 200 at the plate accommodating section 104.

At this time, the floor portion 104A of the plate accommodating section 104 is formed at a higher position than the track surface FL. However, in the present embodiment, a folding structure of the casters 120 is applied such that the trolley 20 can be accommodated at the floor portion 104A of the plate accommodating section 104 without changing the height position of the trolley 200. That is, the support of the trolley 200 is passed over from the casters 120 to the help rollers 212 so that the trolley 200 is passed over smoothly from the track surface FL whose level is different from that of the floor portion 104A. As a result, the plate accommodating section 104 may be structured to have a high rigidity due to the periphery thereof being enclosed by a frame body (a so-called closed cross-sectional structure). Also, this structure allows the plate accommodating section 104 to use a cover body which has an excellent light shielding performance.

After the trolley 200 has been accommodated at the plate accommodating section 104, the sheet delivery section 106 alternately takes the photopolymer plates 102 and the interleaf sheets 118 from the stacked state thereof and passes them onto the plate feed section 108. The photopolymer plates 102 which have been passed onto the plate feed section 108 are transported by the common transport section 128 and the photopolymer plate transport section 130, then fed to the surface plate 110, and discharged after a predetermined image has been exposed. On the other hand, the interleaf sheets 108 are transported by the common transport section 128 and the interleaf transport section 134, and then stacked at the interleaf accommodating section 132 by the sheet material enforcement stacking device 141 which is provided at the trolley 200.

When the photopolymer plates 102 and the interleaf sheets 118 are taken out from the magazine 208 by the suckers 124 and the suction fans 126, of the suction transport device 109, the separating plates 211 are engaged with one of the photopolymer plates 102 so as to curve the tip end corner portions of this photopolymer plate 102, and peel the photopolymer plate 102 from one of the interleaf sheets 118 which is together with the photopolymer plate 102. As a result, separability of the photopolymer plates 102 improves, thus improving reliability of the suction transport device 109.

In this case, because the separating plates 211 can move in the widthwise direction of the photopolymer plates 102 which are accommodated in the magazine 208, in cases in which a photopolymer plate 102 of a different size is sucked and taken out, since the separating plates 211 which have been made movable are moved in accordance with the size of the photopolymer plates 102, even when the photopolymer plates 102 of a different size are used, the relative positions of the separating plates 211 and the photopolymer plates 102 can correspond at a fixed position. Accordingly, both of the tip end corner portions of the photopolymer plates 102 can always be curved at a fixed curvature. As a result, separability of the photopolymer plates 102 improves more, thus improving reliability of the suction transport device 109.

There are disposed a plurality of suckers 124 and suction fans 126 which take out one of the photopolymer plates 102 from the magazine 208 at positions that oppose the photopolymer plates 102 in the widthwise direction thereof. Among the plurality of the suckers 124 and the suction fans 126, those located at the central portion thereof are provided fixedly, while the suckers 124 and the suction fans 126 located at the widthwise direction both end sides of the photopolymer plates 102 are provided so as to be movable in the widthwise direction of the photopolymer plates 102. Accordingly, in cases in which a photopolymer plate 102 of a different size is sucked and taken out, when the suckers 124 and the suction fans 126 which have been made movable are moved in accordance with the size of the photopolymer plates 102, the suckers 124 and the suction fans 126 can be applied to photopolymer plates 102 of any size.

Particularly in this case, the number of the suckers 124 and the suction fans 126 is not increased (the pitch with which the suckers 124 and the suction fans 126 are disposed is not decreased), the suckers 124 and the suction fans 126 can be established so as to suck portions closer to the widthwise direction end portions of the photopolymer plates 102 thus decreasing a curvature when the corner portions of the photopolymer plate 102 are curved so that a so-called separability of the photopolymer plates 102 can improve.

In this suction transport device 109, when one of the photopolymer plates 102 is taken out by the suckers 124 from the magazine 208, an interleaf sheets 118 which is a protective sheet for a surface of the photopolymer plate 102 is held by the interleaf sheet holding plates 217 so that the interleaf sheet 118 is prevented from slipping and falling from the photopolymer plate 102. And in this case, these interleaf sheet pressing plates 217 are provided fixedly at positions that oppose the suckers 124 and the suction fans 126 which are located at the central portion thereof. Thus, regardless of the size of the photopolymer plates 102, that is, the size of the interleaf papers 118, a relative positional relationship between the suckers 124 and the suction fans 126 located at the central position thereof, and the interleaf sheet pressing plates 217 is fixed so that peelability of the interleaf sheets 118 can be maintained stably.

In this way, in the suction transport device 109 according to the first embodiment of the present invention, manufacturing cost can be reduced by decreasing the number of the suckers 124 and the suction fans 126 which are needed to take out the photopolymer plates 102 which are accommodated in the magazine 208. Further, separability of the printing plates improves as a photopolymer plate 102 is to be taken out, thus improving reliability of the device.

Second Embodiment

A description of a second embodiment of the present invention will be given hereinafter. The second embodiment of the present invention relates to an establishing an appropriate position that corresponds to the size of the photopolymer plate 102 for the suction transport device 109 in the sheet delivery section 106, and to a positioning thereof. The suction transport device 109 and the sheet delivery section 106 have been already described in the first embodiment of the present invention.

As illustrated in FIGS. 5 and 6, in the same manner as the first embodiment of the present invention, in the second embodiment of the present invention also, the suckers 124 and the suction fans 126 which are located at the widthwise direction both end portions of the photopolymer plates 102 and the interleaf sheets 118 can move in the widthwise direction of the photopolymer plates 102 and the interleaf sheets 118. Accordingly, a description of the structure relating to the moving mechanism of the suckers 124 and the suction fans 126 will be omitted.

Figure 16A:
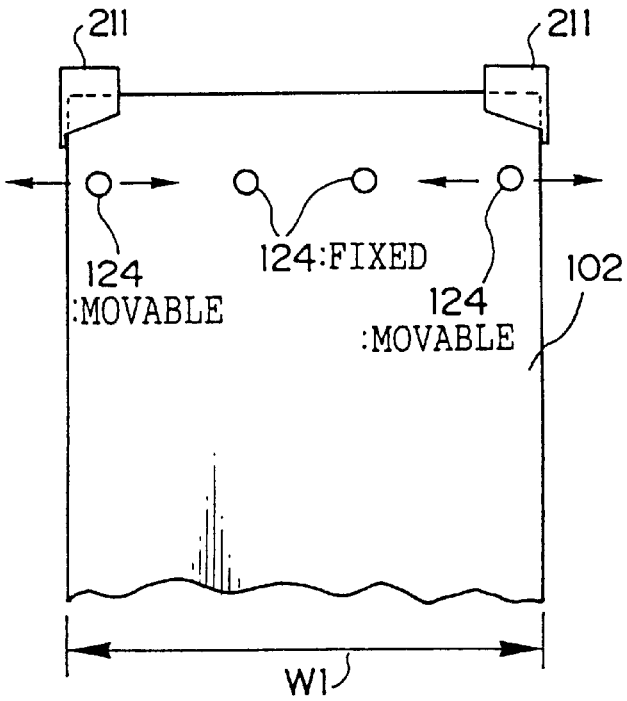
FIG. 16A is a plan view of a photopolymer plate for describing a second embodiment of the present invention.
Figure 16B:
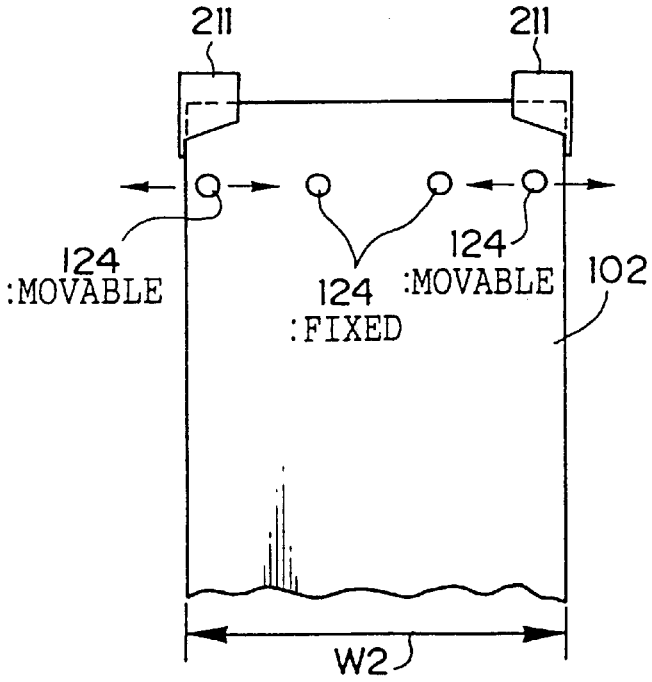
FIG. 16B is a plan view of the photopolymer plate for describing the second embodiment of the present invention.

FIGS. 16A and 16B show a relative positional relationship between the photopolymer plates 102 and the suckers 124 according to the second embodiment of the present invention.

The size of the photopolymer plate 102 shown in FIG. 16A (width W1) and the size of the photopolymer plate 102 shown in FIG. 16B (width W2) are different from each other (W1>W2). In accordance with this, it is found that the suckers 124 and the separating plates 211 which have been made movable are moved to predetermined positions. In this case, two suckers 124 located at the center of all the suckers 124 are fixed.

In this state, in the first embodiment of the present invention, a description of detailed conditions when one of the photopolymer plates 102 is made to contact the suckers 124, sucked, and lifted up was not given. Therefore, in this second embodiment of the present invention, as shown in Table 1, positions of the suckers 124 are determined by setting at least four conditions.

TABLE 1

| | | | | Second embodiment of the present invention | |
|---|---|---|---|---|---|
| | | Constraint conditions | | Lower limit | Upper |
| No. | Items | Lower limit | Upper limit | value | limit value |
| 1 | plate curvature amount | -minimum curvature at which plate can be separable | -separating plates and the like are not displaced from plate→curvature is formed | 5 mm | 9 mm |
| 2 | distance between plate leading end and sucker | -does not interfere with structural members such as rollers -suckers are located inside plate | -minimum curvature at which plate can be separable | | 50 mm or less |
| 3 | distance between plate side end and sucker | -does not interfere with structural members such as suckers and plate | -minimum curvature at which plate can be separable | | 50 mm or less |
| 4 | height of sucker during formation of curvature | -minimum curvature at which plate can be separable | -separating plate and the like are not displaced from plate→curvature is formed | | 8 mm or more form bottom surface of separating plate |

Figure 19:
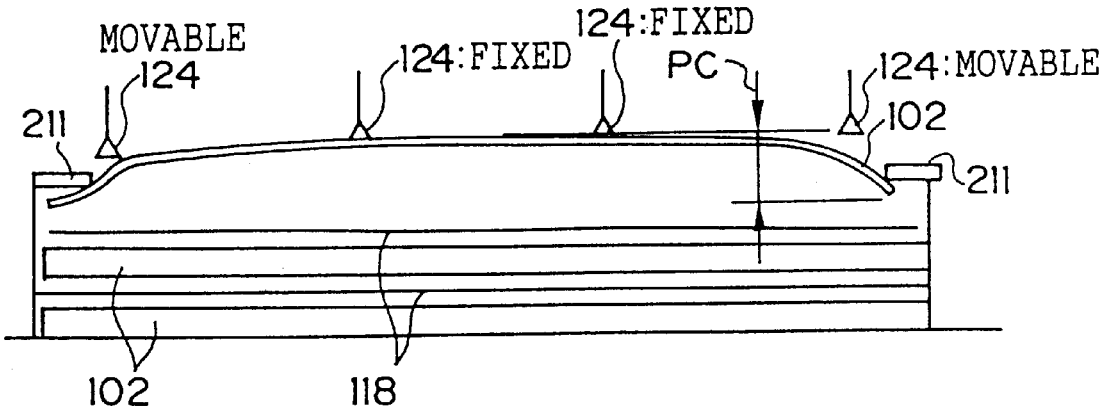
FIG. 19 is a front view as viewed from the tip end portion of the photopolymer plate according to the second embodiment of the present invention, and illustrates a relative positional relationship of the suckers and the like, with respect to the photopolymer plate.

In Table 1, a plate curvature amount (item 1), as shown in FIG. 19, refers to a dimension PC between the widthwise direction one end height position of the photopolymer plate 102 and the uppermost end surface of the photopolymer plate 102 when sucked by the fixed suckers 124.

When the curvature amount is 5 to 9 mm, the photopolymer plate 102 is reliably held by the suckers 124.

Figure 18:
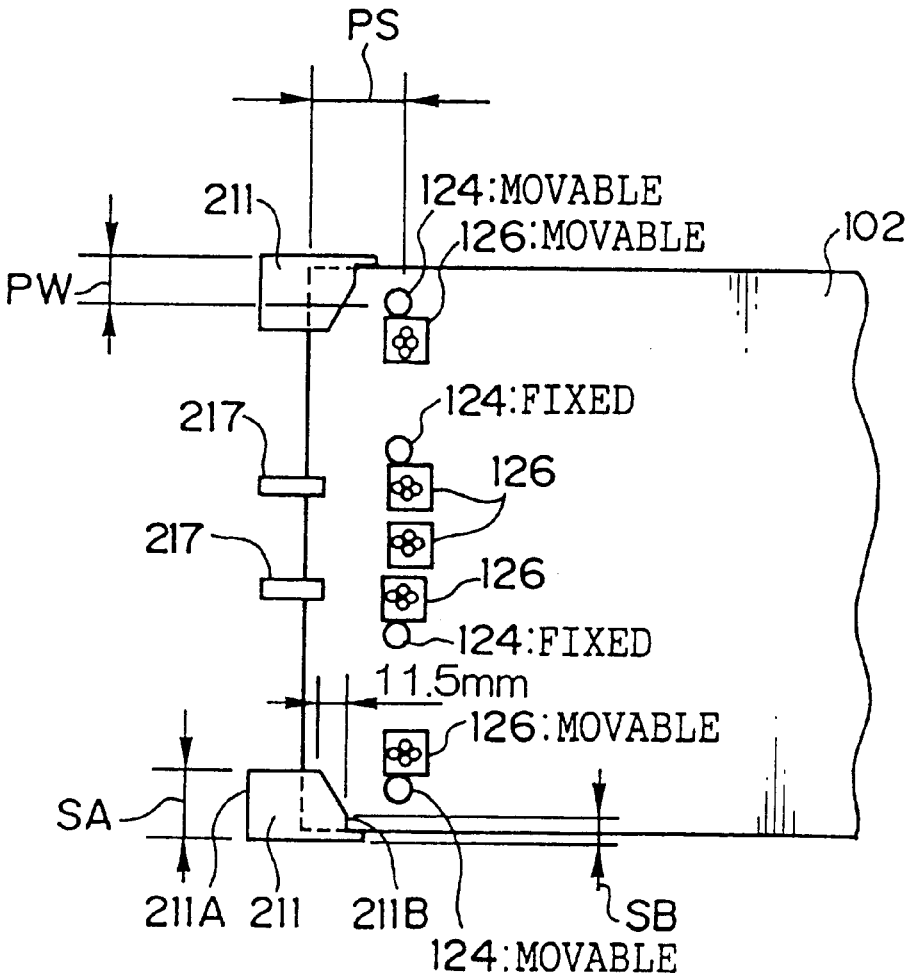
FIG. 18 is a plan view of the photopolymer plate according to the second embodiment of the present invention, and illustrates a relative positional relationship of suckers and the like, with respect to the photopolymer plate.

Next, a position of the suckers 124 from the leading end portion of the photopolymer plate 102 (item 2) of Table 1, as shown in FIG. 18, refers to a distance PS between the leading end portion of the photopolymer plate 102 and the center of the suckers 124.

Figure 17:
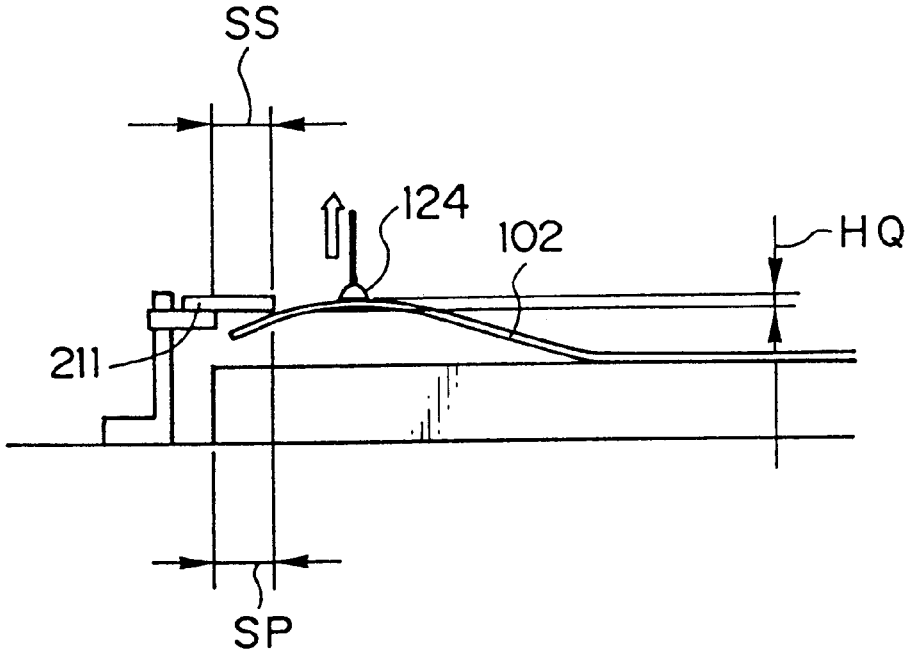
FIG. 17 is a side view of the photopolymer plate according to the second embodiment of the present invention, and illustrates a state in which the photopolymer plate is suctioned.

This dimension PS is 50 mm or less, and preferably 35 mm or less. In the second embodiment of the present invention (in the same manner as the first embodiment of the present invention), the dimension PS is a fixed value. Further, the dimension PS is largely determined by positions and configurations of the separating plate 211. In the second embodiment of the present invention, as shown in FIG. 17, an overlap amount SP of each of the separating plates 211 and the photopolymer plate 102 is 3 to 6 mm, and a free end length SS of the separating plate 211 is 7.5 mm.

As shown in FIG. 18, a dimension SA of a side 211A parallel to the photopolymer plate 102 widthwise direction is 30 mm, and a dimension SB of a side 211B parallel to the side 211A is 6 mm.

A position of the suckers 124 from the side end portion of the plate (item 3) of Table 1, as shown in FIG. 18, refers to a dimension PW from the photopolymer plate 102 widthwise direction both end portions to the center of the suckers 124 closest thereto.

This dimension PW is an important adjustment dimension, and varies in accordance with the dimension of the photopolymer plate 102. However, basically, even when photopolymer plates 102 of a different size is used, the position of the suckers 124 may be adjusted such that the dimension PW is maintained at 50 mm or less.

Lastly, the height of the suckers 124 during the formation of curvature of the plate (item 4) of Table 1, as shown in FIG. 17, refers to a height dimension HQ from the bottom surface of the separating plate 211 to the surface of the suckers 124 at which the photopolymer plate 102 is sucked.

The height dimension HQ is the dimension for obtaining a minimum curvature amount that allows the separating plates 211 to pick up the photopolymer plate 102, and is 8 mm or more, and preferably 12 mm or more.

Figure 20:
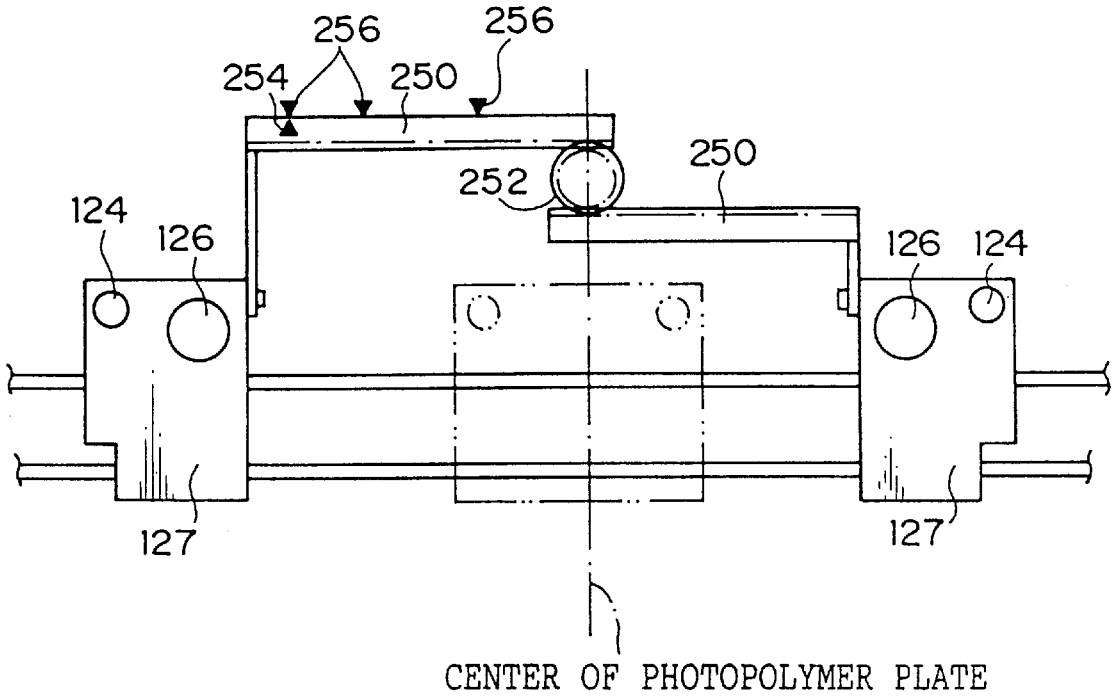
FIG. 20 is a plan view of a moving mechanism of movable suckers according to the second embodiment of the present invention.

As shown in FIG. 20, a unit of movable suckers 124 (which are mounted on the brackets 127 together with the suction fans 126) are provided respectively at the left and right sides of the brackets 127 (corresponding to both ends of the phopolymer plates 102 in the widthwise direction thereof). In the second embodiment of the present invention in which the photopolymer plate 102 is used as a main reference, since a pair of the racks 250 and the pinion 252 are structured so as to mesh with each other, the movable suckers 124 have a structure in which when one of the suckers 124 moves, the other moves in the reverse direction (in directions which differ by 180 degrees) by the same distance as one of the suckers 124 moves. This structure is the same as the moving mechanism of the separating plates 211, a description of which was given in the first embodiment of the present invention.

The rack 250 which is attached to one of the suckers 124 has a plurality of indicators 254 stamped or printed thereon, and corresponding to these indicators, a plurality of positioning markers 256 are stamped or printed at the magazine body.

Each of the markers 256 corresponds to a dimension of the photopolymer plates 102. When the suckers 124 are positioned at appropriate positions, the indicators 254 formed at the racks 250 are made to correspond to a predetermined mark 256 and thereby facilitate the positioning of the suckers 124 at appropriate positions.

Figure 21:
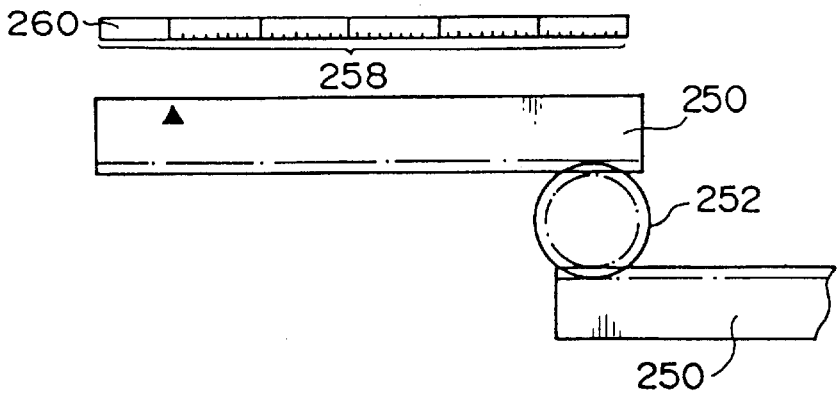
FIG. 21 is a plan view of a variant example of the moving mechanism of the movable suckers according to the second embodiment of the present invention.

When the photopolymer plates 102 are mounted on the magazine with a widthwise direction side of the photopolymer plates 102 as a reference, only the sucker 124 at the side opposed to the widthwise direction side can move in accordance with the dimension of the photopolymer plates 102. As shown in FIG. 21, the markers 256 can be replaced by a scale 260 having graduations 258. This scale 260 can always be in a mounted state, or when necessary, an operator can move the suckers 124 setting the scale 260 along moving tracks of the racks 250.

The suction fans 126, as well as the suckers 124 are used in units so that the suction fans 126 can be moved to appropriate positions. Further, when the separating plates 211 are moved in accordance with the movements of the suckers 124, the positioning operation is further simplified, thus improving operability.

Thus, in the second embodiment of the present invention, in order to position the suckers 124 at appropriate positions, since a relative positional relationship (dimension) between the photopolymer plates 102 and the separating plates 211 is made apparent (see Table 1), the suckers 124 can always be positioned at appropriate positions relative to the photopolymer plates 102. As a result, the degree of failure when one of the photopolymer plates 102 is sucked and taken out from the magazine 208 can be reduced largely.

As described above, in the suction transport device 109 according to the present invention, the number of the suckers 124 and the suction fans 126 which are needed to take out one of the photopolymer plates 102 which are accommodated in the magazine 208 can be reduced, thus leading to a reduction of manufacturing cost. Further, separability of the photopolymer plates 102, as one of the photopolymer plates 102 is to be taken out, improves, thus improving reliability of the device.

In addition to this, a position for sucking the photopolymer plate 102 at which the separability is maximized can be clearly established.

What is claimed is:

1. A suction transport device for use with printing plates, the device comprising:

a container in which printing plates are accommodated when the device is used, with the printing plates stacked on top of one another; and a plurality of suction mechanisms disposed at positions opposing the printing plates, along a width direction of the printing plates, at least one of the suction mechanisms being movable in the width direction, said at least one of said suction mechanisms being movable in a direction substantially perpendicular to a direction in which said printing plates are fed out of said container, and further wherein the suction mechanisms are operable for removing each printing plate from the container, separately from the other printing plates.

2. The suction transport device of claim 1, wherein each printing plate includes a leading end corner portion, and the container includes separation plates disposed movably in the width direction of the printing plates at positions corresponding to the leading end corner portions of said printing plates, the separation plates helping to separate an uppermost printing plate from the plurality of said printing plates.

3. The suction transport device of claim 1, wherein the printing plates include opposite ends, and the suction mechanisms, located at an end of said printing plates are movable in the width direction of said printing plates.

4. The suction transport device of claim 3, wherein said suction mechanisms are positioned on the basis of marks.

5. The suction transport device of claim 4, wherein said suction mechanisms are movable along tracks of said suction mechanisms, and the marks are points defining scale along the tracks.

6. The suction transport device of claim 1, wherein suction mechanisms located in a central vicinity of the width direction of said printing plates, have a fixed position.

7. The suction transport device of claim 1, wherein each said printing plate includes an interleaf sheet, separating each printing plate from an adjacent printing plate in the container, and the suction mechanisms include suckers and suction fans.

8. The suction transport device of claim 7, wherein when one of said printing plates is to be removed from said container, the printing plate is brought into contact with the suckers and pressed thereagainst due to negative pressure provided in said suckers, and when one of said interleaf sheets is to be removed from said container, the suction fans operate first, and thereafter the suckers are activated for removing the interleaf sheet.

9. The suction transport device of claim 7, wherein some of said suction mechanisms have a fixed position for holding said interleaf sheets, and said container includes pressing plates provided at positions corresponding to the suction mechanisms that have a fixed position.

10. The suction transport device of claim 1, wherein at least two of said suction mechanisms are disposed on opposite sides of a central portion of said container along said width direction, and further wherein said at least two suction mechanisms move in tandem and to a substantially equal extent with respect to said central portion.

11. A suction transport device for use with a plurality of printing plates and interleaf sheets, each printing plate having opposite ends and a leading end corner portion, with each printing plate separated from an adjacent printing plate by an interleaf sheet, the device comprising:

a container in which the printing plates and interleaf sheets are placed when the device is used, the container including separation plates disposed movably in a width direction of the printing plates at positions corresponding to leading end corner portions of said printing plates, for aiding in separating an uppermost printing plate in the container from the remaining printing plates of said plurality; and a plurality of suction mechanisms disposed in the width direction of said printing plates at positions opposing said printing plates, with suction mechanisms located along the width direction at either end of said printing plates being disposed movably, and those located in a central vicinity of the width direction of said printing plates being disposed fixedly, the suction mechanisms being operable such that said printing plates and said interleaf sheets are sucked and removed from said container separately from one another.

12. The suction transport device of claim 11, wherein said separation plates are movable relative to one another, and said suction mechanisms which are disposed movably, are further movably independent of one another.

13. The suction transport device of claim 11, wherein said container includes pressing plates disposed in a central vicinity of the width direction of said printing plates, the pressing plates being for holding said interleaf sheets.

14. The suction transport device of claim 11, wherein said suction mechanisms include suckers and suction fans, and when one of said printing plates is to be removed from said container, the printing plate is brought into contact with the suckers due to negative pressure provided in said suckers, and when one of said interleaf sheets is to be removed from said container, the suction fans are operated first, and then the suckers are activated to cause one of said interleaf sheets to press thereagainst, for alternately removing a printing plate and then an interleaf sheet.

15. The suction transport device of claim 11, wherein said suction mechanisms that are disposed movably are positioned on the basis of marks.

16. The suction transport device of claim 15, wherein said suction mechanisms that are movable, are mounted on tracks, and the marks are points on a scale defined along the tracks.

17. The suction transport device of claim 11, wherein at least two of said movably disposed suction mechanisms are disposed on opposite sides of a central portion of said container along said width direction, and further wherein said at least two suction mechanisms move in tandem and to a substantially equal extent with respect to said central portion.

18. The suction transport device of claim 11, wherein said movable suction mechanisms move in a direction substantially perpendicular to a direction in which said printing plates are fed out of said container.

19. A suction transport device for printing plates having a width and opposite ends, the device comprising:

a magazine which accommodates printing plates therein, when the device is operated, with the printing plates stacked on top of one another; and a plurality of suction mechanisms disposed along the width of said printing plates in the magazine, at positions opposing said printing plates, with suction mechanisms located in a central vicinity of the width of said printing plates being disposed fixedly, and a suction mechanism located at each end of the printing plates being disposed movably, wherein said movable suction mechanisms move in tandem and to a substantially equal extent with respect to a central portion of said magazine, the suction mechanisms being operable for sucking and removing the printing plates one at a time from the magazine.

20. The suction transport device of claim 19, wherein said printing plates include an interleaf sheet separating each printing plate from an adjacent printing plate when accommodated in the magazine, each printing plate having a leading end corner portion, and the magazine including separating plates disposed movably along the width of said printing plates accommodated in said magazine, so as to correspond to the leading end corner portions of said printing plates, and when one of said printing plates is to be removed from said magazine by said suction mechanisms, the separating plates engage the printing plate and curve the leading end corner portion of said printing plate for peeling said printing plate away from other printing plates in the magazine.

21. The suction transport device of claim 19, wherein said magazine includes interleaf sheet pressing plates disposed fixedly at positions opposing at least some suction mechanisms located in said central vicinity so as to correspond to interleaf sheets accommodated in said magazine, and which, when one of said interleaf sheets is to be removed from said magazine by said suction mechanisms, engages with one of said interleaf sheets and holds the interleaf sheet.

22. The suction transport device of claim 19, wherein the suction mechanisms that are movable, are positioned on the basis of marks.

23. The suction transport device of claim 22, further comprising tracks on which said suction mechanism are mounted movably, and said marks being points defining a scale along the tracks.

24. The suction transport device of claim 19, wherein said movable suction mechanisms move in a direction substantially perpendicular to a direction in which said printing plates are fed out of said magazine.

* * * * *